US012588763B2

(12) United States Patent
Ehrenleitner

(10) Patent No.: US 12,588,763 B2
(45) Date of Patent: Mar. 31, 2026

(54) SEATING FURNITURE

(71) Applicant: EB-INVENT GMBH, Altensteig-Walddorf (DE)

(72) Inventor: Franz Ehrenleitner, Altensteig-Walddorf (DE)

(73) Assignee: EB-INVENT GMBH, Altensteig-Walddorf (DE)

( * ) Notice: Subject to any disclaimer, the term of this patent is extended or adjusted under 35 U.S.C. 154(b) by 228 days.

(21) Appl. No.: 18/451,701

(22) Filed: Aug. 17, 2023

(65) Prior Publication Data

US 2024/0008647 A1 Jan. 11, 2024

Related U.S. Application Data

(63) Continuation-in-part of application No. PCT/EP2021/079923, filed on Oct. 28, 2021.

(30) Foreign Application Priority Data

Feb. 19, 2021 (DE) ..... 102021104004.3

(51) Int. Cl.
*A47C 1/032* (2006.01)
*A47C 3/18* (2006.01)
*A47C 3/20* (2006.01)

(52) U.S. Cl.
CPC ..... *A47C 1/03255* (2013.01); *A47C 1/03211* (2013.01); *A47C 1/03227* (2013.01);
(Continued)

(58) Field of Classification Search
CPC ..... A47C 1/023; A47C 1/03261; A47C 7/024
See application file for complete search history.

(56) References Cited

U.S. PATENT DOCUMENTS 1,836,630 A * 12/1931 Thum ..... A47C 7/441 297/312
4,521,053 A * 6/1985 de Boer ..... A47C 1/0244 297/312

(Continued)

FOREIGN PATENT DOCUMENTS

DE 3731708 A1 4/1989
DE 102018114207 B3 3/2019

(Continued)

*Primary Examiner* — Rodney B White
(74) *Attorney, Agent, or Firm* — Raven Patents, LLC; Anton E. Skaugset

(57) ABSTRACT

Seating furniture, in particular, a chair having a plane of symmetry, a seat surface, a backrest, a kinematic arranged on a base of the seating furniture, which has a base arm, which is rotatable relative to the base around a base axis (A1), an end arm, which is rotatable around a base arm around an intermediate axis (A2), and a furniture part that is mounted to rotate around the end arm around an end axis (A3), where the three axes (A1, A2 and A3) intersect at a central point (Z, Z1). To achieve versatile mobility, the pivotable furniture part is the backrest, that the seat surface is mounted to rotate relative to the backrest around a connection axis running orthogonally to the plane of symmetry, and that the seat surface is connected to the base via a support kinematic that constrains at least one degree of freedom.

37 Claims, 16 Drawing Sheets

(52) U.S. Cl.
CPC ..... *A47C 1/03233* (2013.01); *A47C 1/03261* (2013.01); *A47C 3/18* (2013.01); *A47C 3/20* (2013.01)

(56) References Cited

U.S. PATENT DOCUMENTS

| | | | | |
|---|---|---|---|---|
| 4,765,679 | A * | 8/1988 | Lanuzzi | A47C 1/03283 297/316 |
| 5,113,851 | A * | 5/1992 | Gamba | A47C 3/18 297/330 X |
| 5,401,077 | A * | 3/1995 | Hosoe | A47C 1/0308 297/316 |
| 5,409,295 | A * | 4/1995 | Edstrom | A47C 3/0255 248/372.1 |
| 5,536,067 | A * | 7/1996 | Pinto | A47C 7/024 297/215.15 |
| 5,716,099 | A * | 2/1998 | McDiarmid | A47C 7/024 297/284.11 |
| 6,189,971 | B1 * | 2/2001 | Witzig | A47C 1/023 297/284.11 |
| 6,331,152 | B1 | 12/2001 | Holle | |
| 6,578,918 | B1 * | 6/2003 | Rinne | A47C 7/46 297/320 |
| 6,752,459 | B2 * | 6/2004 | Deisig | A47C 7/024 297/316 |
| 6,761,406 | B2 * | 7/2004 | Kinoshita | A47C 7/16 297/301.3 |
| 6,863,346 | B2 * | 3/2005 | Zund | A47C 1/03272 297/321 |
| 7,195,583 | B2 * | 3/2007 | Leib | A47C 7/506 482/52 |
| 7,350,863 | B2 * | 4/2008 | Engels | A47C 7/40 297/284.3 |
| 7,350,865 | B2 * | 4/2008 | Pearse | A47C 7/144 297/312 |
| 7,637,570 | B2 * | 12/2009 | Becker | A47C 1/03255 297/312 |
| 7,922,248 | B2 * | 4/2011 | Aldrich | A47C 1/023 297/316 |
| 8,262,162 | B2 * | 9/2012 | Castro, Jr. | A47C 7/027 297/285 |
| 8,419,133 | B2 * | 4/2013 | Holt | A47C 1/03266 297/284.3 |
| 8,469,454 | B2 * | 6/2013 | Holt | A47C 1/03255 297/284.3 |
| 8,752,896 | B2 * | 6/2014 | Takeuchi | A47C 1/03272 297/341 |
| 8,944,507 | B2 * | 2/2015 | Goetz | A47C 9/005 297/321 |
| 8,960,796 | B2 * | 2/2015 | Aldrich | A47C 7/40 297/284.3 |
| 9,352,468 | B2 | 5/2016 | Ehrenleitner | |
| 9,504,325 | B2 * | 11/2016 | Sander | A47C 1/03255 |
| 9,504,330 | B2 * | 11/2016 | Gehner | A47C 7/443 |
| 9,968,196 | B2 | 5/2018 | Ehrenleitner | |
| 10,058,180 | B2 * | 8/2018 | Desanta | A47C 1/03255 |
| 10,159,347 | B2 * | 12/2018 | Costaglia | A47C 1/03255 |
| 10,595,636 | B2 * | 3/2020 | Jin | A47C 1/03255 |
| 10,780,003 | B2 * | 9/2020 | Beyer | A61G 5/122 |
| 10,820,704 | B2 * | 11/2020 | Sugano | A47C 7/02 |
| 10,842,272 | B2 * | 11/2020 | Costaglia | A47C 1/03255 |
| 10,842,275 | B2 * | 11/2020 | Kinoshita | A47C 7/00 |
| 10,842,276 | B2 * | 11/2020 | Sugano | A47C 9/002 |
| 10,856,660 | B2 * | 12/2020 | Kinoshita | A47C 7/14 |
| 10,945,529 | B2 * | 3/2021 | O'Boyle | A47C 7/448 |
| 10,973,326 | B2 | 4/2021 | Ehrenleitner | |
| 11,253,077 | B2 * | 2/2022 | Yajima | A47C 7/563 |
| 11,261,905 | B2 | 3/2022 | Ehrenleitner | |
| 11,337,526 | B2 * | 5/2022 | Gilchrist | A47C 7/445 |
| 11,471,345 | B2 * | 10/2022 | Beyer | A47C 9/005 |
| 11,533,998 | B2 * | 12/2022 | Kinoshita | A47C 7/44 |
| 11,596,232 | B2 * | 3/2023 | Goetz | A47C 7/14 |
| 11,779,121 | B2 * | 10/2023 | Gilchrist | A47C 7/445 297/301.1 |
| 11,805,905 | B2 * | 11/2023 | Goetz | A47C 7/46 |
| 11,844,440 | B2 * | 12/2023 | Schüller | A47C 7/402 |
| 2009/0261642 | A1 * | 10/2009 | Dickie | A47C 9/002 297/314 |
| 2010/0259082 | A1 * | 10/2010 | Votteler | A47C 1/03272 297/285 |
| 2014/0103688 | A1 * | 4/2014 | Wilson | A47C 7/46 297/284.7 |
| 2018/0206647 | A1 * | 7/2018 | Kieryllo | A47C 9/005 |

FOREIGN PATENT DOCUMENTS

| | | | | |
|---|---|---|---|---|
| EP | 0105955 | A1 * | 4/1984 | A47C 7/024 |
| EP | 263323 | A * | 4/1988 | A47C 1/03255 |
| EP | 0341344 | A2 * | 11/1989 | A47C 7/024 |
| EP | 2438883 | A1 * | 4/2012 | A47C 7/024 |
| EP | 3193670 | A1 | 7/2017 | |
| EP | 3476254 | A1 | 5/2019 | |
| JP | 3026232 | U * | 7/1996 | A47C 7/024 |
| JP | 10327967 | A * | 12/1998 | A47C 7/024 |
| WO | WO-9746144 | A1 * | 12/1997 | A47C 7/024 |
| WO | 2012123102 | A1 | 9/2012 | |
| WO | 2016042127 | A1 | 3/2016 | |

* cited by examiner

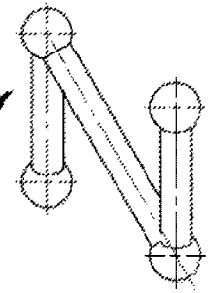
Fig. 17A
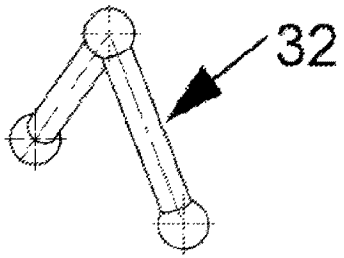
Fig. 17B
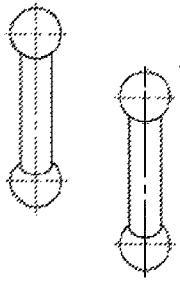
Fig. 17C
Fig. 17D
Fig. 17I
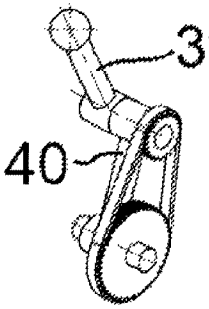
Fig. 17J
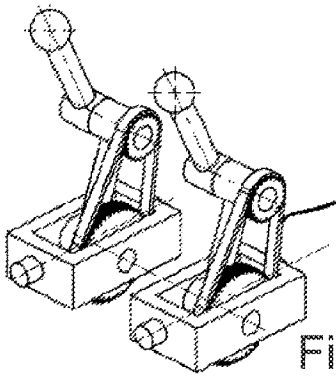
Fig. 17K
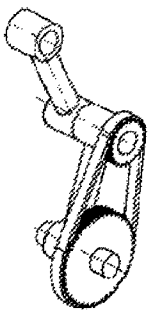
Fig. 17L
Fig. 17E
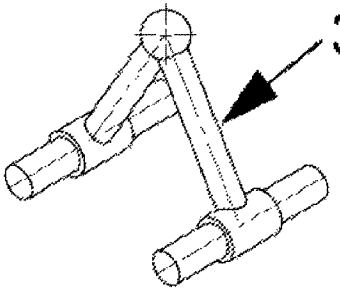
Fig. 17F
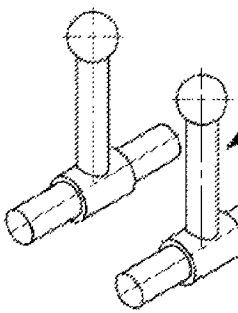
Fig. 17G
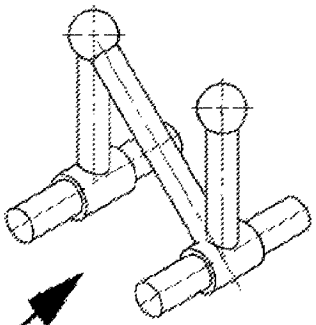
Fig. 17H

SEATING FURNITURE

CROSS-REFERENCE TO RELATED APPLICATIONS

The present application is a continuation-in-part under 35 USC § 120 of International application serial no. PCT/EP2021/079923, international filing date Oct. 28, 2021 (hereby incorporated by reference), which in turn claims the priority under 35 USC § 119(a) of German patent application DE 102021104004.3, filed Feb. 19, 2021.

TECHNICAL FIELD

The present disclosure relates to articles of seating furniture, such as a chair, and more particularly, to office chairs having a plane of symmetry in which the seat surface and the backrest are pivotable relative to one another about a horizontal transverse axis extending orthogonally to the plane of symmetry.

BACKGROUND

The present disclosure relates to pivoting mechanisms having two kinematic systems mounted on a common base. Each kinematic system has a base arm rotatable around the base, an end arm rotatable around the base arm around an intermediate axis, and the object to be pivoted, which is rotatable around the end arm around an end axis. These three axes of the single kinematic system (base axis, intermediate axis, and end axis) intersect at a central point around which the object to be pivoted can carry out a spherical movement. This type of kinematic system is referred to simply as a "kinematic" in the description and claims. Since two such kinematics are provided and the two central points formed by them are at a distance from each other, the object to be pivoted can only be pivoted about the virtual axis between the two central points. Such a device was used in a piece of seating furniture called Maniola, in which the two central points define the hypothetical or virtual transverse axis orthogonal to the plane of symmetry, and the object to be pivoted is the seat surface of the seating furniture, which also pivots the backrest firmly attached to it.

It is known from WO 2016/042127 A1, corresponding to EP 3 193 670 and U.S. Pat. No. 9,968,196 of the applicant, to provide only one such kinematic between any two furniture parts and to limit the mobility by a guide pin on one of the parts and a connecting link in the other part. It is also stated that it is not necessary that the three axes actually intersect each other at a point, the central point; it is sufficient if they come close to each other in a central area, with minimal distances of a few centimeters not posing a problem in use for seating furniture in which the kinematic is provided between a base and the seat surface. For the calculation of forces, moments, and movements, one intersection point (in the technical, not the mathematical sense) is advantageous and preferred.

It is known from DE 10 2018 114 207 B3 of the applicant, corresponding to U.S. Pat. No. 11,261,905 B2, to equip a piece of seating furniture with only one such kinematic, which is articulated to the seat surface as an "end object" so that the seat surface and the backrest mounted elastically thereto move about the central point of the kinematic as in a ball-and-socket joint, and thus also in directions other than orthogonal to the plane of symmetry, wherein the extent of pivotability is achieved by a corresponding additional lever-and-joint structure. The disadvantage of this solution, similar to the first mentioned one, is that when the seating furniture is tilted back, the front edge of the seat surface is raised sharply, which causes constriction of the blood vessels in the front area of the user's thigh and is therefore uncomfortable during prolonged sitting and is not permitted by many standards.

In the special form of application without lateral swiveling, in the so-called Maniola chair mentioned above, this raising is desired and deliberately brought about in order to achieve a resting position lying very far back, which almost corresponds to lying down, and constriction is prevented by an extendable footrest.

From EP 3 476 254 of the applicant, corresponding to U.S. Pat. No. 10,973,326 B2, it is also known to divide the seat surface in seating furniture that can be tilted about a horizontal transverse axis by means of different kinematics, and to ensure by means of a corresponding support kinematic that when the backrest and therefore also the rear part of the seat surface are tilted back, the front part of the seat surface folds away downward or is not raised or hardly raised at all, so that constriction at the thigh is avoided.

In this seating furniture, there is also no possibility of transverse movement, which is understood to mean movement around an axis of rotation lying in the plane of symmetry and mostly running essentially horizontally, also known as the longitudinal axis. Such transverse swiveling is medically indicated, because on the one hand, it stimulates the continuous activation of various muscle groups that are otherwise relaxed during sitting, and because, on the other hand, such transverse movement is also desired by the user in various areas of application, such as video games or the like.

Seating furniture having a plane of symmetry in which the seat surface and the backrest are pivotable relative to one another about a horizontal transverse axis extending orthogonally to the plane of symmetry, have been described by WO 2012/123102, corresponding to U.S. Pat. No. 9,352,468 of the applicant.

It should be stated that a person deemed to be skilled in the art would be familiar with all of these documents and could apply their disclosures reasonably and consistently in connection with the teachings of the present disclosure, including its variants, its aspects and various embodiments. For those jurisdictions in which this is possible, the contents of the aforementioned documents is incorporated by reference into the content of the application.

The present disclosure is directed to seating furniture that can be pivoted about a horizontal transverse axis, where the front edge of the seat surface is at least not appreciably raised when in the backward leaning state, and which additionally permits transverse pivoting about a preferably essentially horizontal longitudinal axis that preferably lies in the plane of symmetry, when desired. The pivot axes, as in the aforementioned known designs, should lie clearly above the seat surface and may, but need not, intersect each other.

SUMMARY

The present disclosure relates to articles of seating furniture, particularly chairs, that possess a plane of symmetry and an advantageous mechanical connection between the base of the seating furniture and the seat surface and backrest of the seating furniture.

In one example, the article of seating furniture of the present disclosure has a plane of symmetry, and includes a base of the seating furniture; a seat surface, where the seat surface is optionally divided into a rear seat surface part and a front seat surface part, such that either the seat surface or the front seat surface part is connected to the base via a support kinematic that constrains at least one degree of freedom; a backrest attached to the seat surface or the rear seat surface part; and a kinematic, arranged on a base of the seating furniture. The kinematic, in turn, includes a base arm that is rotatable relative to the base around a base axis; and an end arm that is rotatable around the base arm around an intermediate axis; where the kinematic carries the backrest as an object to be pivoted, and the backrest is mounted so as to be rotatable around the end arm around an end axis; and the base axis, the intermediate axis, and the end axis draw near to one another in a central area; where the seat surface is rotatable relative to the backrest around a connection axis running orthogonally to the plane of symmetry; or the front seat surface part is rotatable relative to the rear seat surface part around a seat division axis running orthogonally to the plane of symmetry.

BRIEF DESCRIPTION OF THE DRAWINGS

FIGS. 17A-17L show the different possibilities of lower connection of FIGS. 16A-16L in greater detail.

DETAILED DESCRIPTION

Figure 1B:
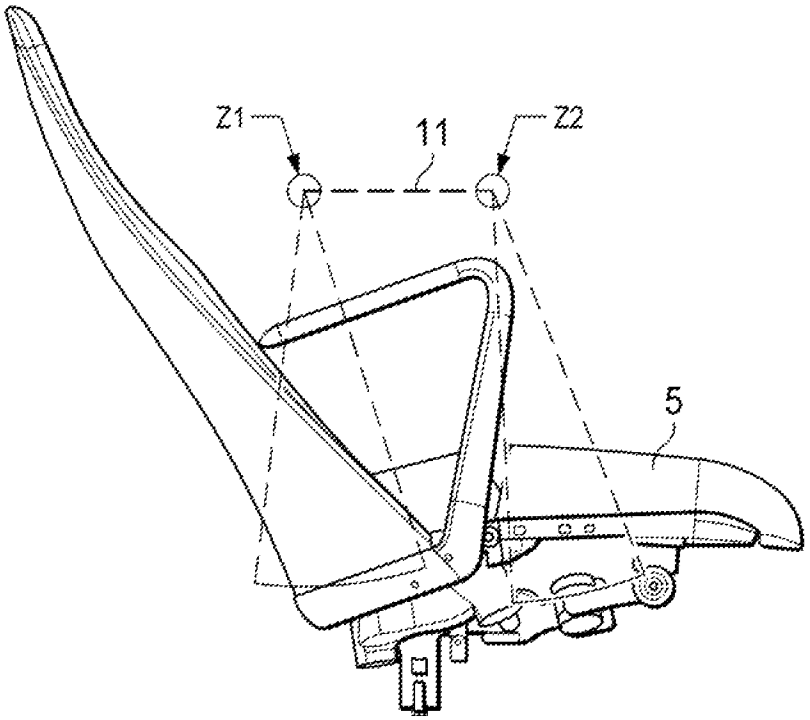
FIGS. 1A and 1B show a side view of seating furniture according to an illustrative embodiment the present disclosure, at rest and pivoted.

The advantageous properties of the seating furniture of the present disclosure are accomplished through the use of a kinematic that is connected to the backrest of the seating furniture so that it can carry out a spherical movement around the central area or the central point of the kinematic lying in the plane of symmetry. The seat, surface, which can be divided, is mounted on the backrest so that it can pivot about the aforementioned transverse axis and is guided by means of one of the support kinematic mechanisms described further below and is thus prevented from folding down freely. The seat surface thus follows the spherical movement and has the additional ability to swivel.

The spherical movement of the backrest can be limited in various ways, as explained below, or restricted to an ordinary forward-backward pivoting.

This gives you a stable, space-saving device, which is particularly important between the upper end of a pneumatic spring of an office chair and the actual seat, including the backrest.

These measures also make it possible to devise a broad range of seating furniture for different applications with only one kinematic system, which greatly reduces the number of different parts, the unit costs are reduced due to the larger number of individual parts, and planning and warehousing are simplified.

A simple refinement of the design provides for a second kinematic, preferably identical in construction to the first, which is connected to the seat surface and arranged in such a way that both central points lie in the plane of symmetry of the seating furniture so that they define a longitudinal axis lying in the plane of symmetry. The angle of this longitudinal axis to the horizontal depends upon the kinematic properties desired by the designer and the area of application, and can be freely selected over a broad range. Significant deviations from the horizontal, even greater than ±45°, are quite appropriate in individual cases, for example, in seating furniture for users of video games, in which spatial movements, possibly produced by motors, are essential, or in seating furniture used as training equipment. For office chairs, deviations from the horizontal of up to ±15° are quite useful, but useful extreme deviations are also mentioned in the description.

The longitudinal axis, or central pivot axis, of the seating furniture of the present disclosure generally assumes an angle of less than 45° relative to the horizontal. For a typical desk chair or office chair the longitudinal axis assumes an angle of less than 15° and more preferably less than 5° relative to the horizontal.

Where the article of seating furniture is intended to provide some health benefits, the angle of the longitudinal axis to the horizontal is between 15° and 30°, preferably between 20° and 27° and most preferably about 25°, running from high at the rear to low at the front. With such an angle, each tilting of the user from left to right and back is combined with a tilting of the seat around the vertical axis, which is, as explained below, tilting together with the seat around the longitudinal axis. The user of the chair instinctively tries to "correct" this, which leads to a hip-movement in regard to the upper body which is very similar to the hip movement when walking. Thereby, the health problems when sitting for a longtime on a chair can be reduced and in many cases totally avoided.

The seating furniture is swiveled around the virtual longitudinal axis, so that the plane of symmetry also necessarily executes this swiveling. Therefore, when a vertical plane of symmetry and various horizontally running axes are mentioned to explain the disclosed seating furniture, this always refers to the configuration of the seating furniture in a position in which there is no swiveling around the longitudinal axis. This configuration was chosen as a basis for easier depiction in the drawing and easier verbal explanation of the figure description.

As mentioned above, the presently disclosed kinematic is applicable both to chairs with a single-piece seat surface and as well as to chairs with a divided seat surface when present, i.e., with a front and rear seat surface part. In chairs with a single-piece seat, surface the pivot axis running orthogonal to the plane of symmetry is provided between the seat surface and the backrest; in chairs with a divided seat surface the rear seat surface part is firmly connected to the backrest and the front seat surface part is connected to the rear seat surface part via the axis, referred to as the seat division axis for differentiation, which runs orthogonal to the plane of symmetry. In either case, this pivot axis can be designed in a variety of ways, from a hinge to an elastic intermediate area, any mechanism that permits a rotary movement about this axis, which may be a virtual axis, is possible.

Chairs with a Divided Seat Surface and Two Kinematics:

The pivoting of the rear seat surface part about the transverse axis, which always passes through the rear central point and is orthogonal to the possibly twisted plane of symmetry, is effected by providing a divided seat surface, where the rear part of this divided seat surface and therefore the backrest (or vice versa) is connected to the rear kinematic and therefore executes a spherical movement around the rear central point; this rear part of the seat surface is connected to pivot with the front part of the seat surface around a seat division axis, running horizontally and in the transverse direction, i.e. orthogonal to the plane of symmetry of the seating furniture, and the front part of the seat surface with the front kinematic assigned to it is connected to a joint that permits movement at least around an axis parallel to the seat division axis.

When the seating furniture is tilted back, the front edge of the rear seat surface part is moved upwards, since the central point lies above the seat surface and thus causes pivoting of the front part of the seat surface around its central point and the seat division axis in a direction through which the front, free edge of the front seat surface is moved downward relative to the rear seat surface part. At the same time, due the change in angular position between the two seat surface parts, a minimal rotational movement of at least one of the two parts occurs around its/their central point. Dividing this minimal rotational movement between the two kinematics occurs as a function of the acting forces and moments.

With regard to the concept of the axis of rotation between the two seat surface parts, the seat division axis, it should be stated, not only for this design, but also in principle, that this could be designed in a variety of ways: starting from a simple axis between the two parts to the design of an elastic intermediate area (virtual axis) or the like running across the seat surface, in which bending occurs due essentially to the elastic properties of the employed material, such as for example plastic, possibly in conjunction with different cross-sectional shapes or designs as chambers, etc., whereby the axis, to a limited extent, is no longer fixed relative to one or both parts. In principle, anything is possible, as long as it permits only pivoting about the horizontal transverse axis, the seat division axis.

With regard to the connection between the rear part of the seat surface and the backrest, it should be stated that this can either be designed as a single piece and relatively rigid, as in the Maniola variant, or that various adjustabilities and the elastic connections could be provided, such as has long been known in office chairs, for example, and that relatively movable connections can also be applied in which the angle between these two elements changes as a function of the angle of inclination and the forces exerted by the user. Such a "dynamic" connection is known, for example, from WO 2016/042127 of the applicant, corresponding to U.S. Pat. No. 9,968,196 B2.

Chairs with a Single-Piece Seat Surface and Two Kinematics:

T These are special cases from the kinematic standpoint, in which the size of the rear seat surface part tends toward zero. The rear kinematic therefore engages on the backrest, optionally via a correspondingly designed support part, the connection on the lower edge of the backrest with the undivided seat surface corresponds, mutatis mutandis, to the connection between the seat surface parts in a divided seat surface.

Since the associated edges of the furniture parts move along circular arcs during rotation of the two furniture parts around their central point around axes orthogonal to the plane of symmetry, the resulting change in length must be compensated for, which best occurs between the two parts themselves, called internal alignment. A sliding movement of one or both furniture parts on its central point can, of course, also be provided in addition or instead.

Connection of the Seat Surface or the Front Seat Surface Parts to the Kinematic:

There is no difference here between the two variants. For connection of the front seat surface part or seat surface to its corresponding end arm of its kinematic, the same applies as for the backrest. As presented below, an intermediate lever with corresponding rotary joints can be used here. Another possibility that can be configured to save space is to provide a cardan joint, which kinematically corresponds to a design of the intermediate lever with a zero length, in which case the position of the axes in space is preferably not orthogonal to each other, since one stipulated axis of the end arm is skewed in space and the other must also necessarily run parallel to the seat division axis or to the connection axis with the backrest.

A ball joint can also be used, in which the spherical mobility intrinsic to the ball joint, insofar as it deviates from rotation about a horizontal transverse axis parallel to the seat division axis, is restrained by the overall kinematic mobility of the seat furniture; this is also easy to provide in the case of a cardan joint.

In some circumstances, depending on the extent of the intended pivoting movement, it may also be possible here to provide an elastically deformable connection that permits the relative movement.

It should be pointed out here in passing that in recent years such elastic connections have found areas of application in which both the paths and the angles, as well as the loads, are incomparably greater than in seating furniture; mention need only be made of car transitions of rail vehicles and also the mounting of car bodies of rail vehicles on their bogies.

Differences Between Divided and Single-Piece Seat Surfaces:

These differences are not qualitative but only gradual, because the corresponding connection sites on the two kinematics change gradually with shortening or elimination of the rear seat surface part, and so do the different angular positions; likewise, the torques and forces occurring between the components connected movably with each other. With knowledge of the present disclosure and the chair being designed, a person skilled in the art can make all the necessary calculations and design the components to match.

Whether or not arm rests are provided and how they are designed, has no causal connection to the kinematic of the present disclosure and can easily be decided upon and designed by a person skilled in the art. The possibility of "doublings" should also be mentioned; instead of one kinematic with a central point, two or more can always be provided as long as their central points coincide. However, if, as explained initially, central areas are found to be insufficient in such a case, at least one of the kinematics must have a true central point.

The seating furniture of the present disclosure may be further explained below with reference to the drawings.

FIGS. 1 to 11 show an exemplary seating furniture variant with two kinematics, one for the backrest, one for the seat surface or the front seat surface part (this essentially corresponds to a variant of the support kinematic explained further below); FIGS. 12 to 18 show exemplary seating furniture variants with a kinematic connected to the backrest and special connections of the seat surface or the front seat surface part to the base of a so-called support kinematic.

Figure 1A:
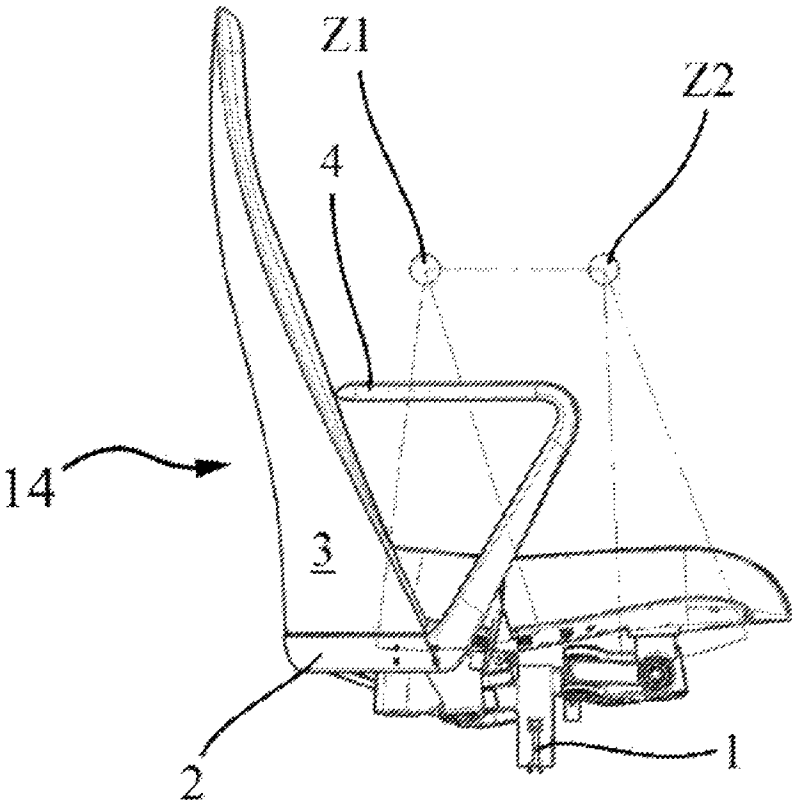

FIGS. 1A and 1B show the upper part of seating furniture 14, for example, an office chair or seating furniture for use in a video game or the like. A base 1 is shown, which belongs either to a chassis or a support frame, as is known from the prior art in numerous embodiments, possibly movable, and/or rotatable around a vertical axis and/or height-adjustable (office chair).

Two three-bar kinematics (generally referred to merely as kinematics), further described below, are connected to base 1. These kinematics are readily apparent from FIG. 3 in a bottom view and shown in detail in FIG. 4. In the depicted embodiment example, the base 1 is provided with two fixed arms, a base arm is connected to each fixed arm to rotate around an axis A1 and to the end arm around an axis A2. The end arm is connected to rotate with corresponding seat surface part around an axis A3.

Depending on the embodiment example, instead of the quasi-radial, central design and connection of the fixed arms to base 1, a plate-like or disk-like sub-base can be provided, on which the two base arms are each mounted to rotate. With knowledge of the present disclosure, the area of application, the load and the available space, it is a simple matter for a person skilled in the art to make a selection or decide on a configuration here.

These two kinematics, which are referred to in their entirety as rear kinematic 6 and front kinematic 7, with which merely their arrangement relative to the rear or front seat part surface 2 or 5 is to be indicated, each have a central point, which is indicated by Z1 and Z2 in FIG. 1. The corresponding axes A1, A2 and A3 intersect at these central points. In this case, a central area can be used without problem instead of a central point.

Figure 2C:
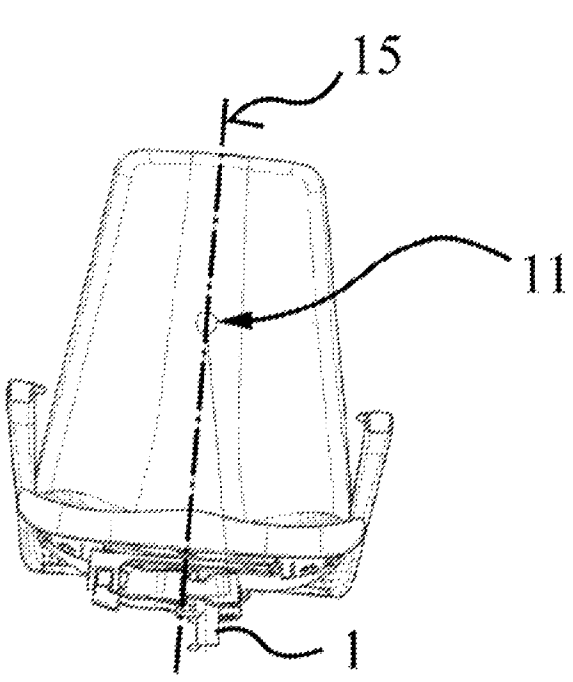
FIGS. 2A-2C show a front view of the seating furniture of FIGS. 1A and 1B, at rest and pivoted.
Figure 2B:
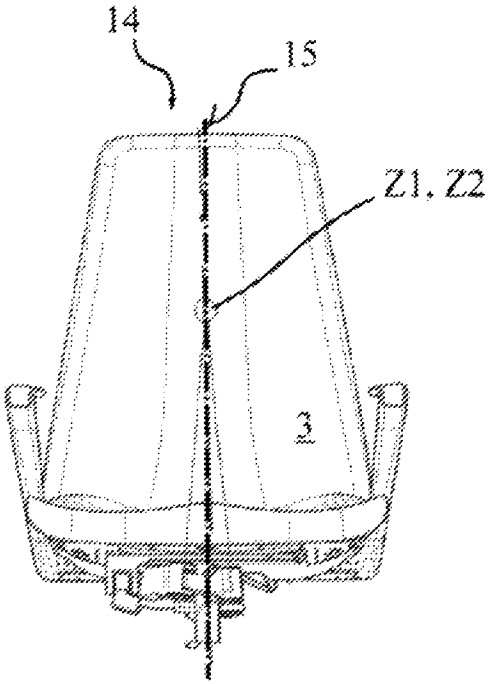
Figure 2A:
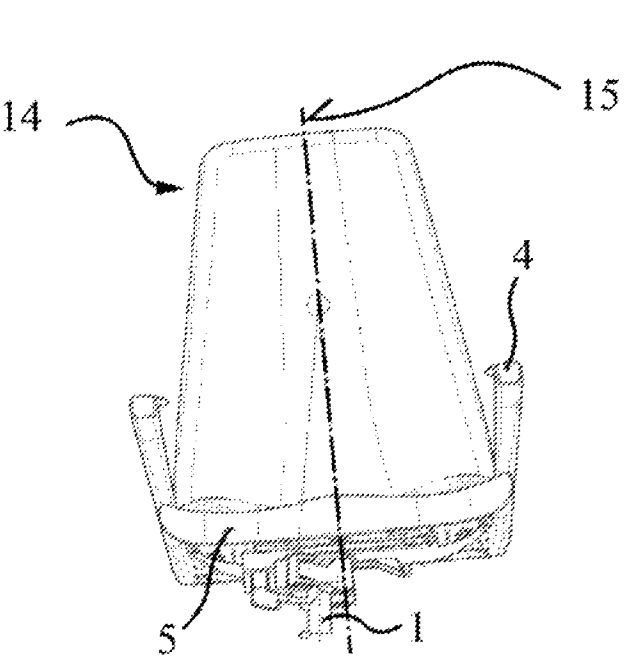
Figure 3:
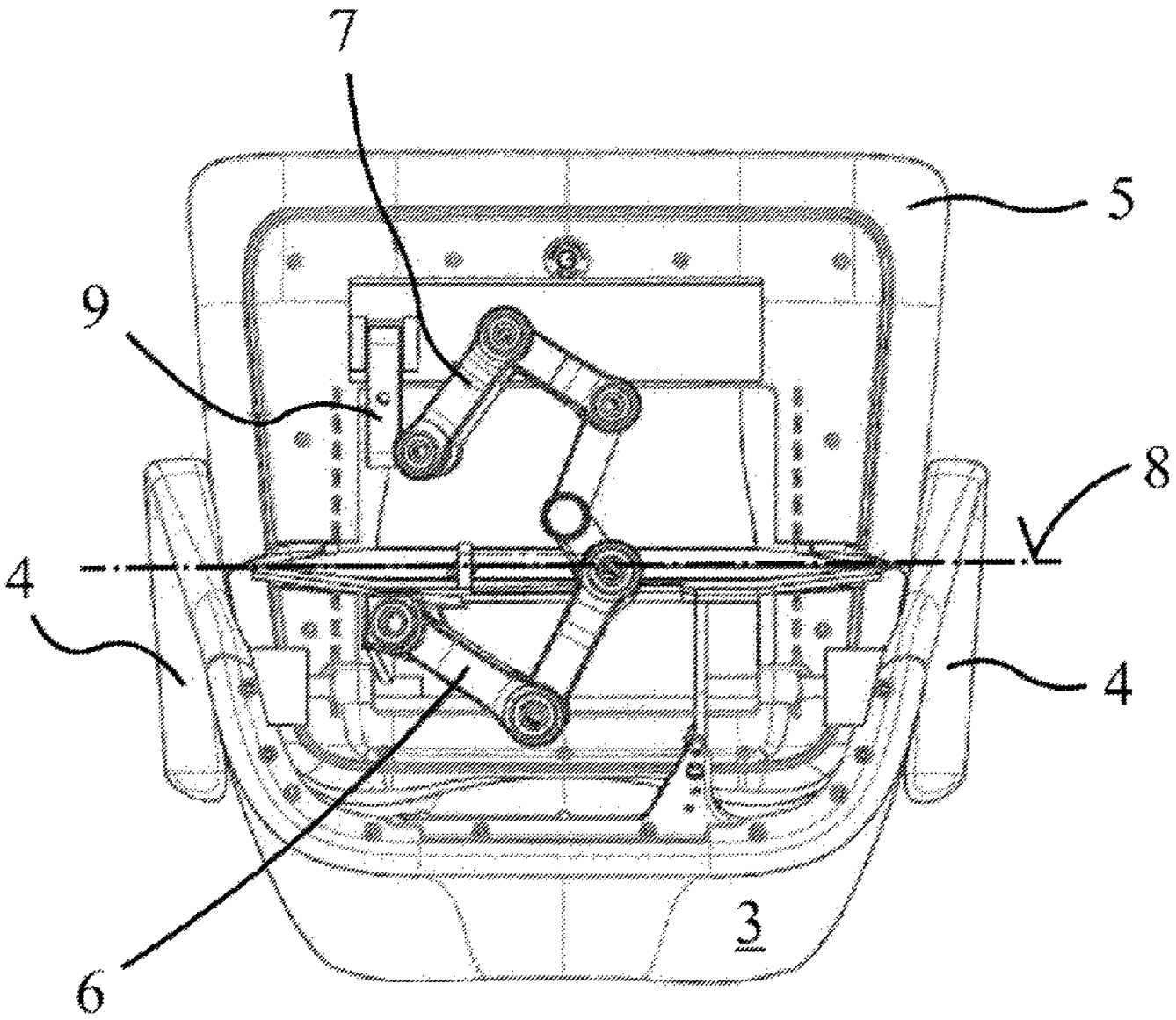
FIG. 3 shows a bottom view of the seating furniture of FIGS. 1A and 1B.

As can be seen both from the side view of FIG. 1 and the front view of FIG. 2, the two central points Z1, Z2 in the depicted embodiment example are positioned at the same height, so that the central pivot axis 11 (FIG. 1) connecting them runs horizontally and in the plane of symmetry of the seating furniture. The mobility of the seating furniture 14 around this central pivot axis 11, the transverse pivot, is readily apparent from the front view of FIGS. 2A-2C, which show three different positions.

With regard to the term plane of symmetry, it should be pointed out that in a design of the base, as in the illustrated embodiment example, as is typical for an office chair, this comprises the vertical axis of rotation of this base 1 and divides the seat surface parts and the backrest into symmetrical left and right halves (virtually). The fact that parts of the kinematics (as in the illustrated embodiment example of the kinematics 6, 7, as is apparent from the bottom view of FIG. 3) and possible height-adjustment mechanisms, etc., run asymmetrically to this plane of symmetry does not diminish their designation and significance.

The side view of FIGS. 1A and 1B shows the seating furniture 14 in an upright position and in the configuration tilted rearward, also called the rest position. As is apparent, when the backrest 3, and therefore the rear seat surface part 2, are tilted back, the front seat surface part 5 is raised along the seat division axis 8 (FIG. 3), so that its change in angular position relative to the rear seat surface part 2 occurs opposite the rotational movement of the rear seat surface part, so that it is lowered with its free end relative to it.

Figure 4:
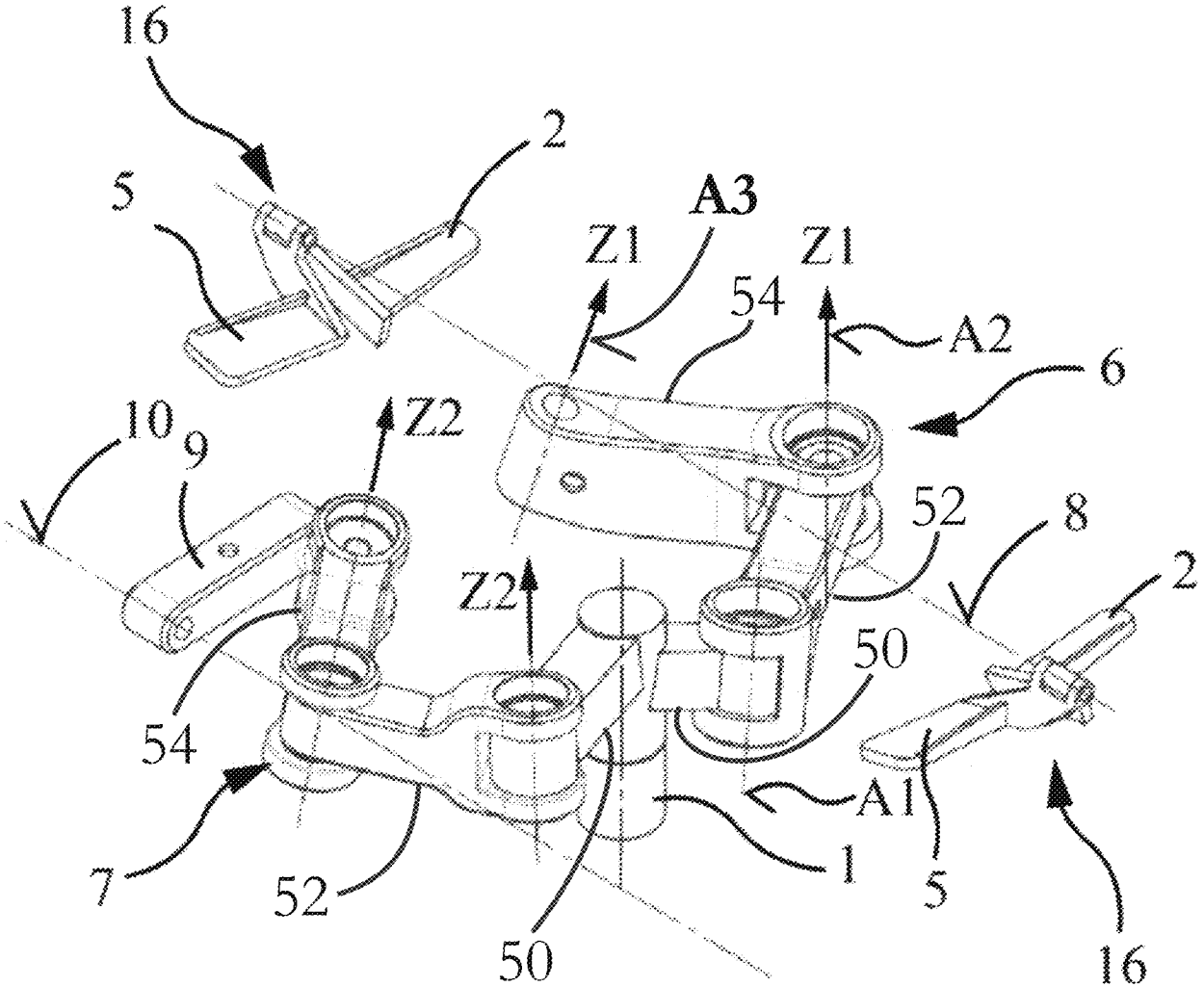
FIG. 4 shows an illustrative example of a kinematic mechanism that can be used in accordance with the present disclosure, referred to as a kinematic for short.
Figure 5B:
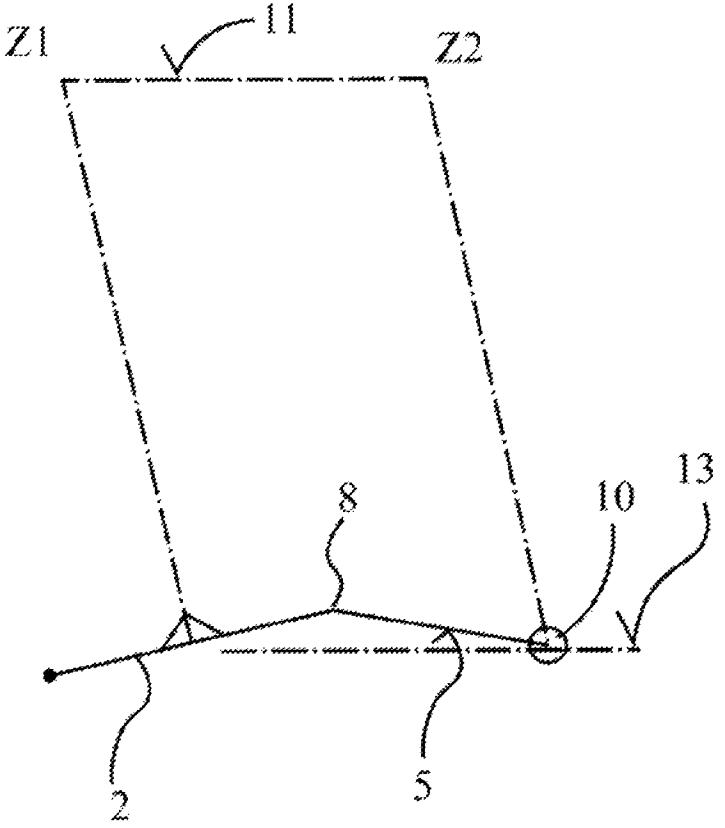
FIGS. 5A and 5B schematically depict the positions of the two seat surface parts of the seating furniture of FIGS. 1A and 1B in the upright and tilted back positions, respectively.
Figure 5A:
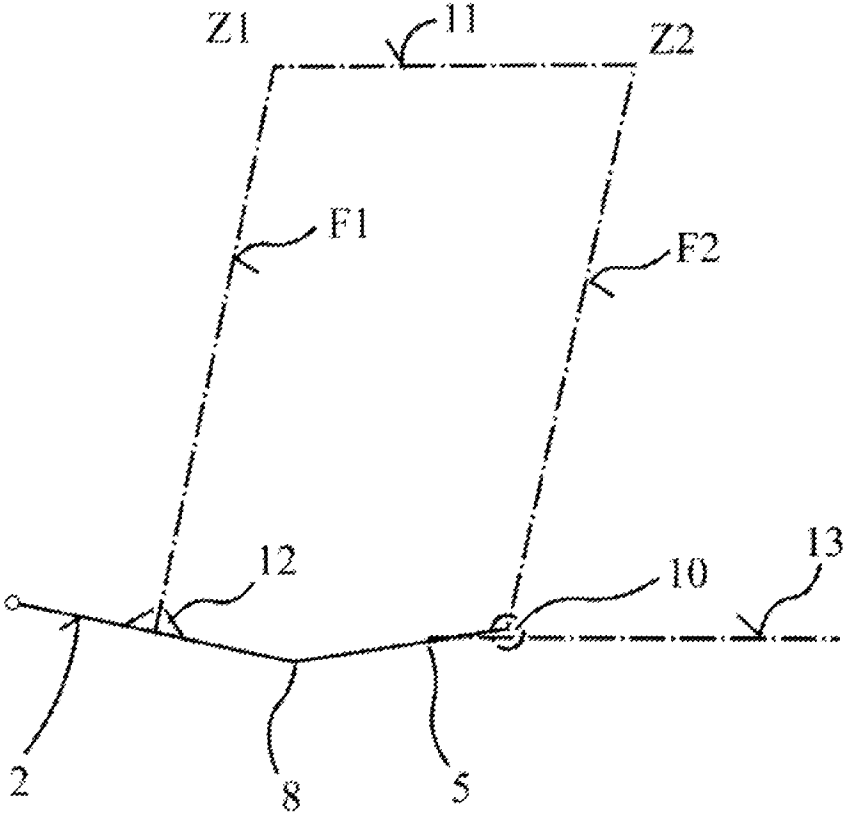
Figure 6B:
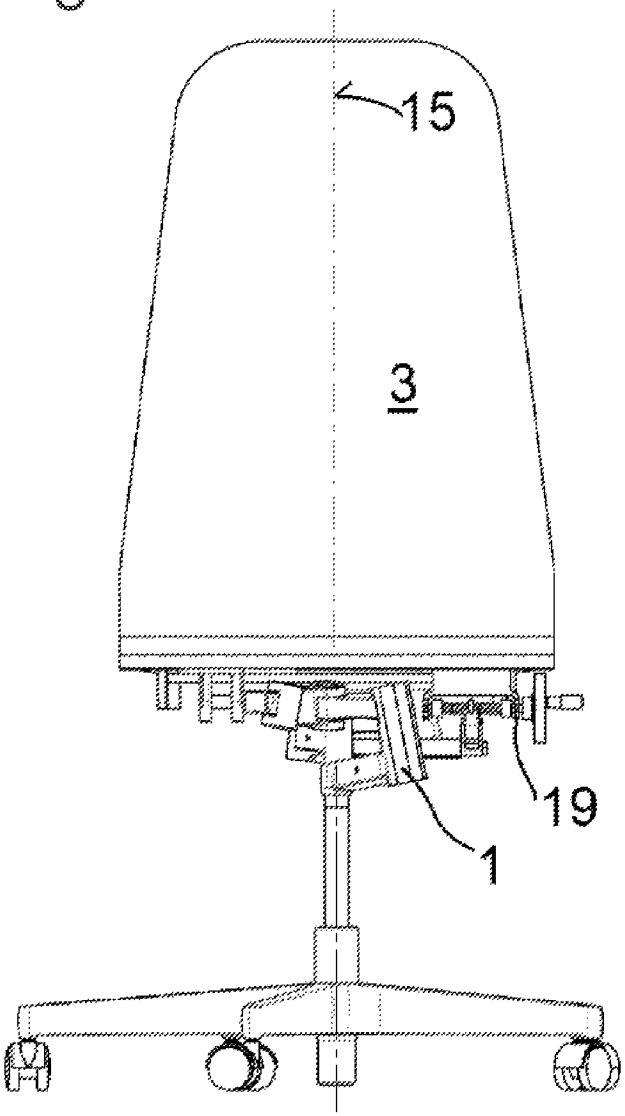
FIGS. 6A and 6B semi-schematically depict seating furniture according to the present disclosure having an undivided seat surface and in the upright state.
Figure 6A:
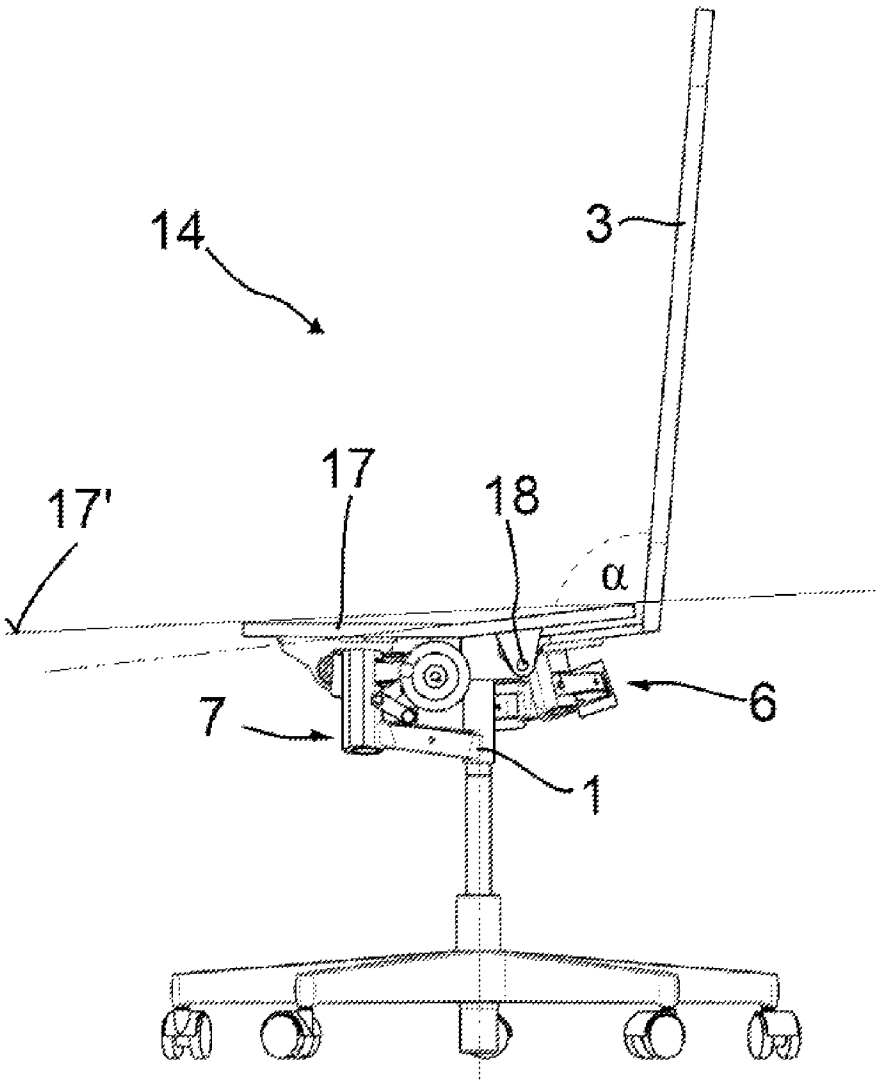

This relative movement and therefore the lowering of the front seat surface part 5 relative to the rear seat surface part 2 is clearly shown schematically in FIGS. 5A and 5B. FIG. 5A represents the upright position of the seating furniture, in which only the two seat surface parts 2, 5 are shown schematically as a dashed line; neither the backrest nor the kinematics are shown, but just the two central points Z1 and Z2. The rear seat surface part 2 or the backrest is thus connected to its kinematic so that it swings about a transverse axis around Z1, so that its angular position always remains unchanged relative to the virtual connection F1, indicated by the (of course, also virtual) "stiffening triangle" 12. The front seat surface part 5 is articulated at its rear side to the front of the rear seat surface part 2 via the seat division axis 8 and suspended to rotate around the front pivot axis 10 parallel to this axis relative to the virtual connection F2 at the corresponding central point Z2, but always maintaining a constant spacing relative to Z2. This flexibility, as shown in FIG. 4, is ensured by the connection arm 9.

A fixed (or fixed relative to the base and thus the central point Z1 and Z2) horizontal 13 is also shown in FIGS. 5A, 5B, and with reference to this horizontal, the vertical position of the front edge of the front seat surface part 5 scarcely changes, so that it is folded away downward relative to the rear seat surface part 2 when the rearward tilted rest position is assumed (FIG. 5B), which shows the angle of the two parts around the seat division axis 8 in direct comparison.

As previously mentioned, this depiction is purely schematic and serves to show the mobility of the individual components. With knowledge of the present disclosure and the area of application, a person skilled in the art can select the (virtual) connection points on the seat surface parts to match the virtual connections F1, F2 and also establish the height of the central points Z1, Z2 above the seat surface parts, and in conjunction with this, the position (angular position relative to the horizontal) of the central pivot axis 11.

A variant of the seating furniture according to the present disclosure is shown in FIGS. 6 to 11 with a single-piece seat surface 17. FIG. 6A shows the furniture, an office chair, from the side in the upright state, FIG. 6B from the rear:

A base 1 is arranged to rotate with adjustable height on a chassis, as known in the prior art. Base 1 includes not only a type of sleeve around the (not shown) pneumatic spring, but an arm directed roughly radially and forward (relative to the seat surface), which in turn supports the front kinematic 7. This kinematic 7 corresponds to the kinematic explained above and creates a central point (not shown) for the seat surface 17, as described above. The seat surface 17 is movable around this central point as in a ball joint. A "seat surface" 17' that joins the two edges of the seat surface 17 is included only for illustration, and its angle α relative to backrest 3 is approximately 98° in the upright position shown.

Base 1 carries in its rear part a rear kinematic 6, corresponding to the kinematic described above, which creates for the backrest 3 a (not shown) central point, as described above. The backrest is movable around this central point as around a ball joint.

The backrest 3 is connected to rotate with seat surface 17 around the connection axis 18, corresponding, mutatis mutandis, to the seat division axis 8 described above. The connection axis is orthogonal to the plane of symmetry 15, which, however (like the seat surface 17 and the backrest 3; but not the kinematics!) is rotatable around the connection line of the two (not shown) central points, the central pivot axis.

Figure 7B:
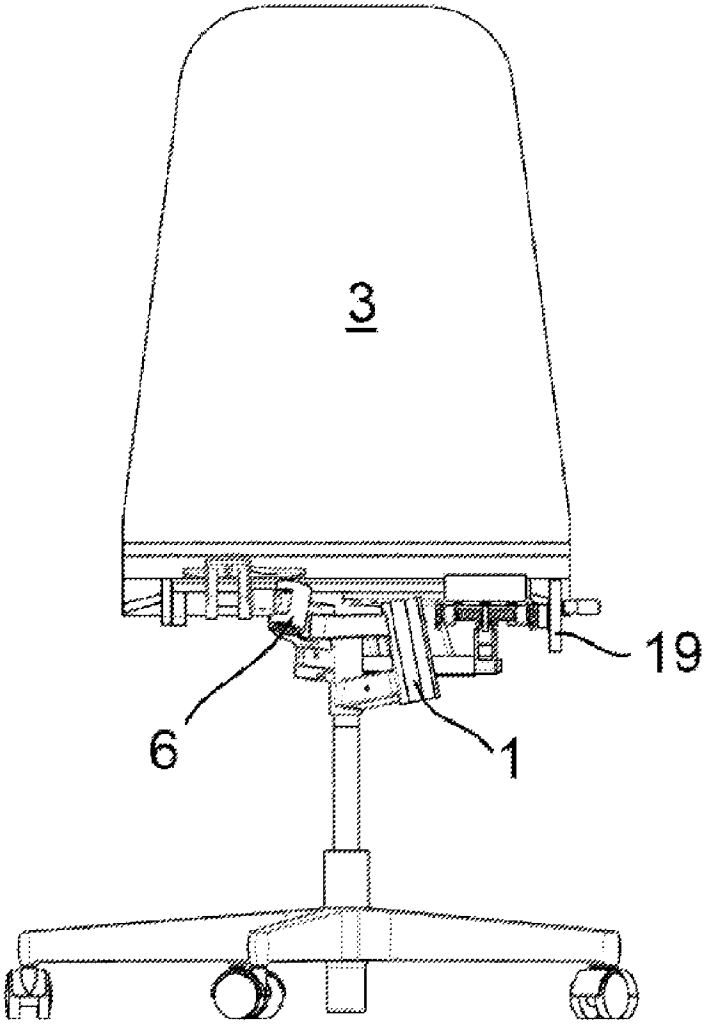
FIGS. 7A and 7B semi-schematically depict the seating furniture of FIGS. 6A and 6B in the tilted back state.
Figure 7A:
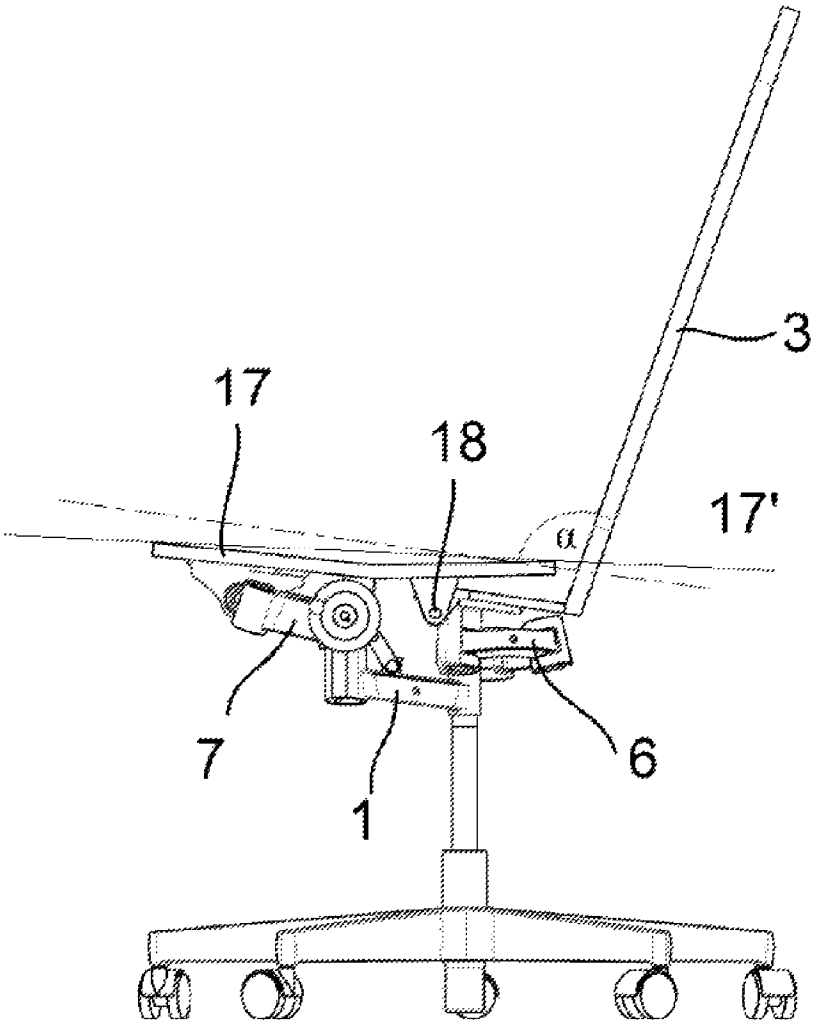

FIGS. 7A and 7B show the situation when backrest 3 is tilted back: the connection axis 18 has been raised by back-tilting and therefore so is the rear part of the seat surface 17. Excessive raising of the front edge of seat surface 17 is therefore prevented without requiring a special mechanism. The angle α between backrest 3 and "seat surface" 17' is now about 108° !

Through the spherical mobility of both partial systems and their rotatable coupling around axis 18, approximately horizontal "length compensation" occurs, as is immediately apparent from the position of the rear edge of seat surface 17 relative to backrest 3.

Figure 8:
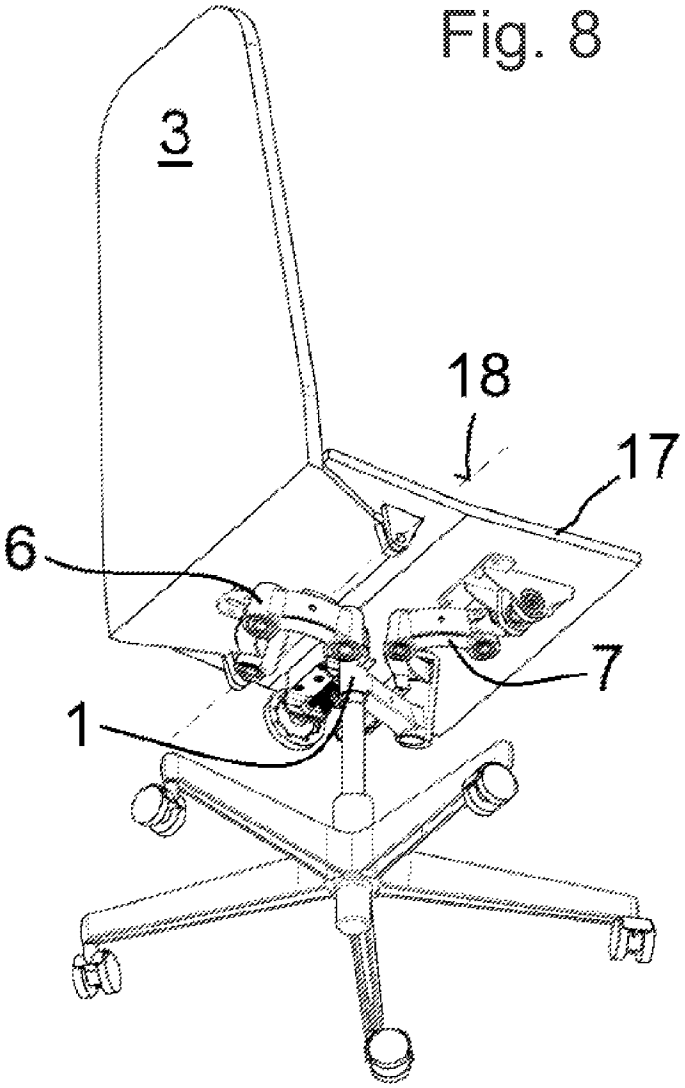
FIG. 8 shows the seating furniture of FIG. 6A from the bottom right.
Figure 10:
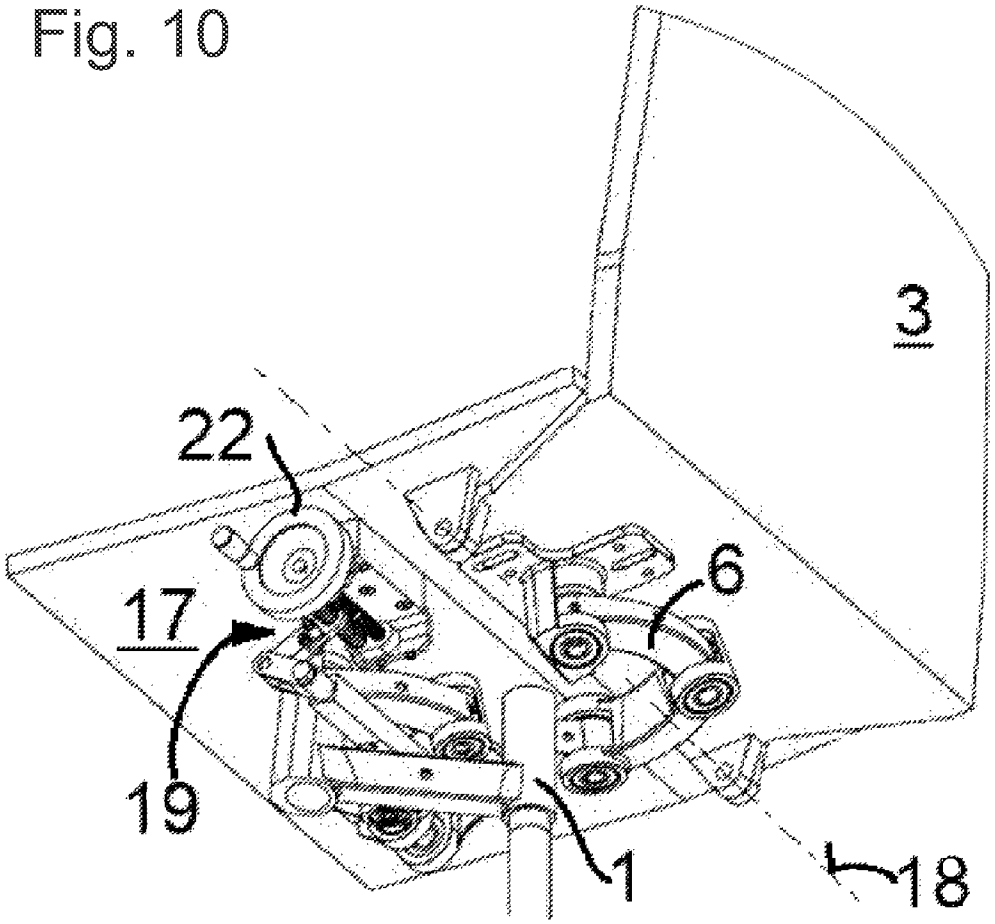
FIG. 10 shows an enlarged depiction of a cutout of FIG. 9.

FIG. 8 shows the office chair from the right rear and below in the upright position. The design of base 1 here and also the position of the connection axis 18 are readily apparent. In the area of the connection between the (front) kinematic 7 and the seat surface 17, a joint is provided, which permits movement at least around one axis parallel to the seat division axis to avoid tilting during pivoting around the central pivot axis.

Figure 9:
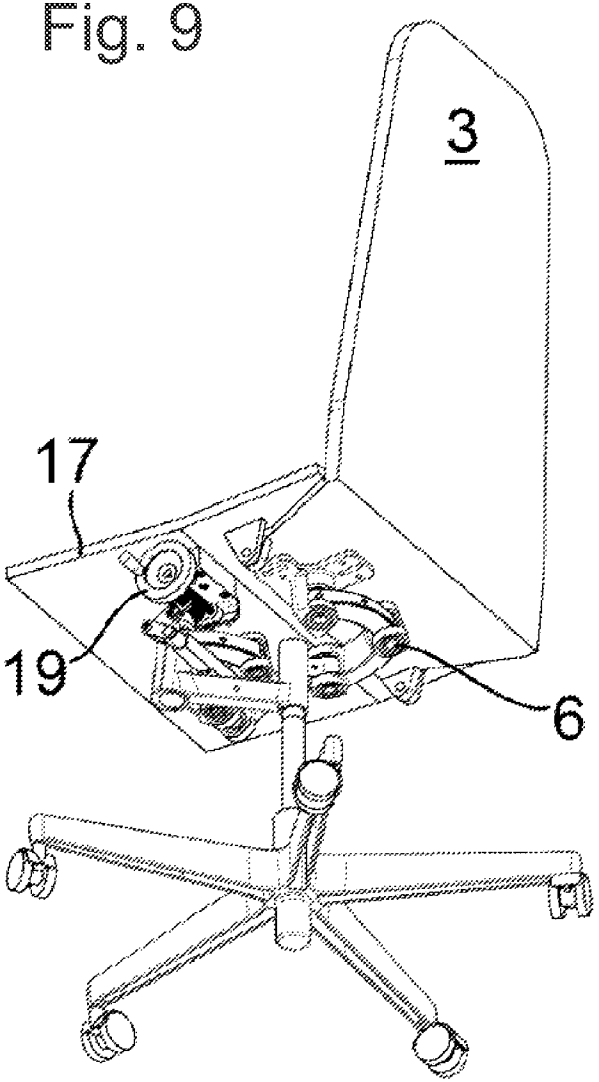
FIG. 9 shows the seating furniture of FIG. 6A from the bottom left.

FIG. 9 shows a view from the left rear and below in which an adjustment device 19 for adjusting the limit of rotation of the seat surface (and therefore also the backrest) around the central pivot axis is visible. This adjustment device 19 and its mounting on the seat surface is more apparent from FIG. 10, an enlargement in conjunction with FIGS. 11A and 11B: a mounting block 20 is connected to the seat surface 17, screwed on in the depicted example. A mounting block 20 carries a spindle 21 with right-hand threads on one side and left-hand threads on the other, on which two nuts 23 secured against rotation are seated. When spindle 21 is turned with a handwheel 22, the two nuts 23 approach each other or increase their separation. The nuts are guided non-rotationally through through-holes, through which a guide rod 24 is fastened in mounting block 20 firmly and parallel to spindle 21.

An adjustment plate 25 that can move freely between the two nuts along guide rod 24 and also be obliquely adjusted because of the larger diameter in comparison with the diameter of the guide rod without tilting can be guided between the two nuts 23 and also by guide rod 24. The possibility of oblique positioning can of course also be provided on the transfer rod 27 or its fastening to base 1, ultimately on every other connection site of the involved components 21-27 and 1.

The intermediate plate 25 is connected by a pivot mechanism 26 to a transfer rod 27, which in turn is fixedly connected to base 1. In the usual case, the distances and angles are chosen so that in the vertical plane of symmetry 15 the intermediate plate 25 is positioned in the center of the guide rod 24 and optionally fixed in this position by the tightened nuts 23, and lateral pivoting around central pivot axis 11 is then not possible. To change this, the user need only rotate handwheel 22 and can thus adjust the extent of possible pivoting.

Figures 11A, 11B:
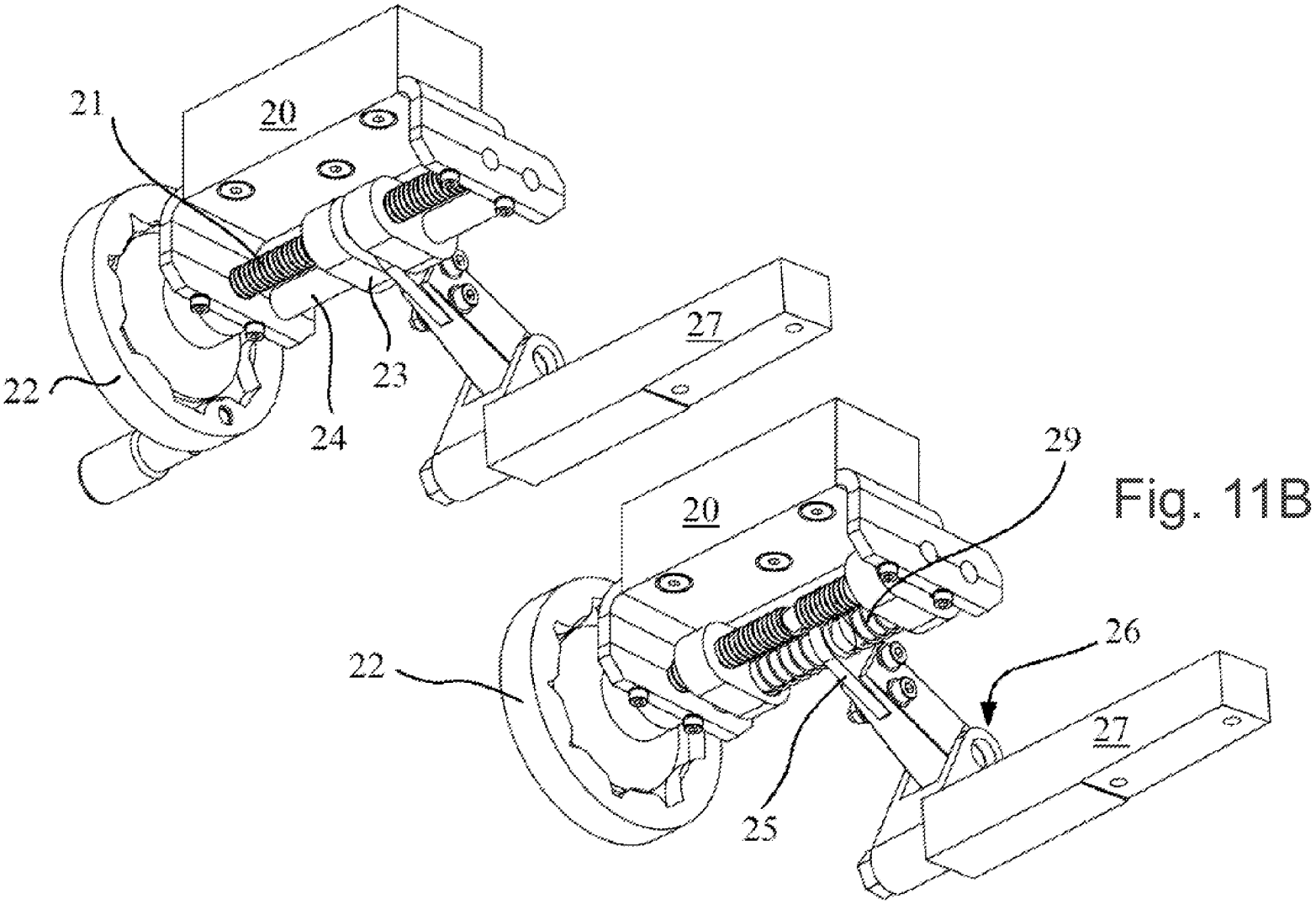
FIGS. 11A and 11B show an adjustment device, in two different settings, as in the seating furniture of FIGS. 6A and 6B.

It is apparent from FIG. 11B that coil springs 29 are arranged on both sides of the intermediate plate 25 around the guide rod 24, which have their stops in recesses of nuts 23. These springs give the user a counter torque during pivoting around the central pivot axis and ensure that the empty chair is positioned with the vertical plane of symmetry if the restoring torque of its mass around the pivot axis is not sufficient. These springs are of course not absolutely necessary.

If such adjustability is not desired, precisely the same chair according to the present disclosure can of course be equipped as shown with a lever-and-joint structure as in DE 10 2018 114 207 B3 or a connecting rod according to WO 2016/042127 A1, so that the extent of pivoting is limited.

With regard to the angles, spacings, and directions indicated variously in the description and in the claims, it should be said that these refer to the seating furniture when resting on a level floor.

Levers, joints, stops, guides, connecting rods and pins, and other types of connecting or linking structures that are configured to limit pivoting movements are not significant for the disclosed seating furniture in themselves and can easily be provided by a person skilled in the art with knowledge of the present disclosure, some examples of which can be found in the literature mentioned at the outset. These elements, as well as any prescribed springs that urge the furniture into a base position (which need not be the rest position or upright position), or motors, which are provided in the case of furniture for video games or the like, are therefore not shown in the drawing and are not explained in the description.

For supplementary purposes only, some dimensions are given below with reference to FIG. 5, which were found to be useful in the design of an office chair according to the present disclosure: the spacing F1, F2 from the corresponding central point to the corresponding seat surface part (normally "abutting" in the rear part at a foot point, leading to the front pivot axis 10 in the front part) can lie between 350 mm and 450 mm with normally thick and normally soft cushioning, the distance between the front pivot axis 10 and the seat division axis 8 can lie between 120 mm and 150 mm, the distance between two central points at 230 mm to 280 mm, the distance from the foot point of F1 to joining of the backrest at 80 mm to 150 mm. These are only approximate guidelines, which can be easily adjusted by a person skilled in the art with knowledge of the present disclosure and the area of application. The criteria and information explained in the aforementioned prior art are also referred to for this purpose.

The terms seat surface part, backrest, arm support are to be understood in the description of the function of the seating furniture without ordinary coatings, coverings, cushioning, etc., even if these are sometimes shown in the figures.

A variant of the present disclosure is further explained in the following FIGS. 12 to 18, which is only provided with the kinematic for the backrest, and accomplishes joining of the seat surface with the front seat surface part in a different way. It should again be pointed out that the transition from the divided to the undivided seat surface occurs quite smoothly and without a significant change in the overall kinematic situation and that it is quite sufficient if the three axes form a central area, although a central point has certain advantages.

The kinematic structure of these variants with only one kinematic and only one central point Z (central area, not additionally explained below) is essentially always the same:

The backrest 3 is joined in the three linear degrees of freedom via the virtual pivot point Z (central point). The rotational degrees of freedom remain open (degrees of freedom (−3)) in which the backrest is connected to rotate with the seat surface (17 or 2 and 5) by a hinge axis (seat division axis 8 or connection axis 18), offering an additional open degree of freedom (−4)) for the seat surface (17 or 2 and 5). This results in the following possibilities:

The seat surface (17 or 2 and 5) is supported at least by means of a simple joining (which again reduces the number of degrees of freedom of the overall mechanism to −3).

As an alternative, the seat surface can be supported by double joining (which reduces the number of degrees of freedom of the overall mechanism to −2).

If there is a desire that the overall structure move only two-dimensionally, a further restriction (of transverse pivoting) can be achieved by an additional joining (three-fold joining) (number of degrees of freedom of the overall mechanism (−1)).

As is clear from this overview, the variant with two kinematics 6, 7 described in detail at the outset is simply an example for a double joining, because the kinematic is connected to the seat surface/front seat surface part via a pivot axis and therefore remains during pivoting around two axes! The front kinematic is therefore a practicable special case of the support kinematic.

As is also readily apparent, it is possible in practice to configure a wide variety of seating furniture always with the same basic components, thus keeping the logistical effort low.

Figure 12A:
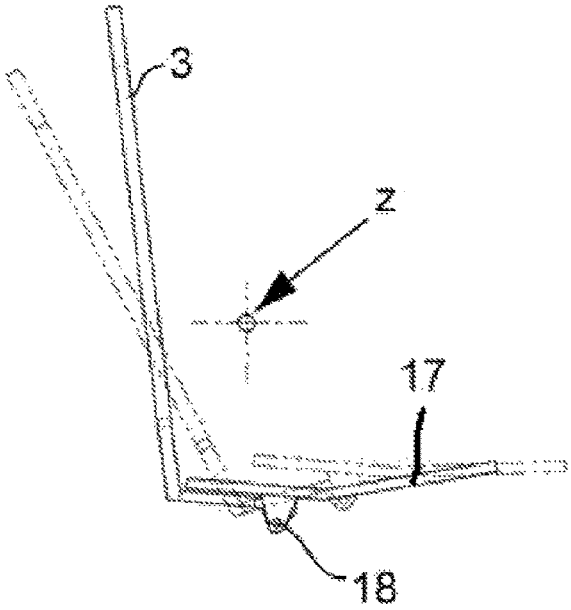
FIGS. 12A and 12B schematically depict seating furniture having only one linkage with a single seat surface and with a divided seat surface.
Figure 12B:
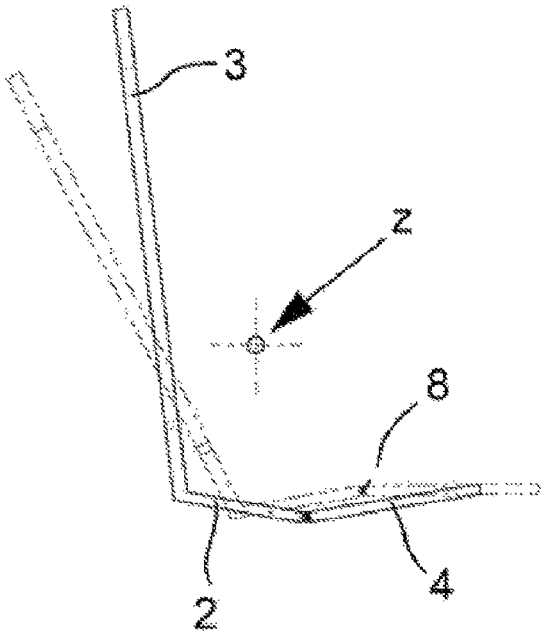

FIGS. 12A and 12B show, extremely schematically, the situation in the plane of symmetry in the upright position with the solid lines and during back tilting with the dashed lines, with undivided seat surface 17, on the one hand, and with the divided seat surface 2, 5, on the other. The backrest 3 is rotated around the (now single) central point Z around an axis orthogonal to the plane of symmetry, which corresponds to the surface of the drawing, the seat surface (the division is only referred to in particular if it applies) also executes a rotation around the axis 18 or 8 extending orthogonally to the plane of symmetry, guided by a support kinematic not shown here. During rotation of the backrest in a different direction (especially left-right) around central point Z, all the depicted parts are also moved so that no change in relative position occurs.

Figure 13A:
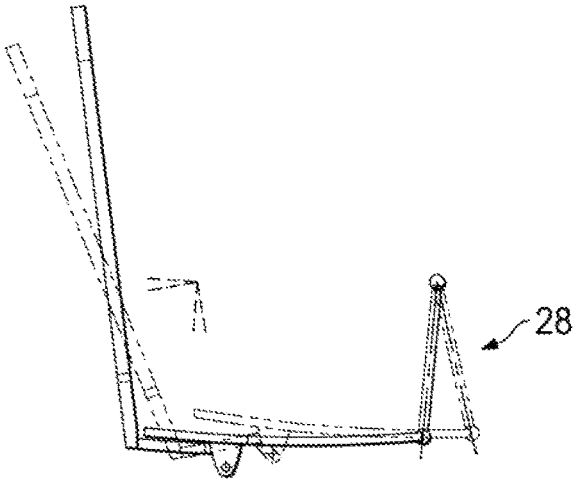
FIGS. 13A and 13B show the seating furniture of FIGS. 12A and 12B with possible "upper" connection.
Figure 13B:
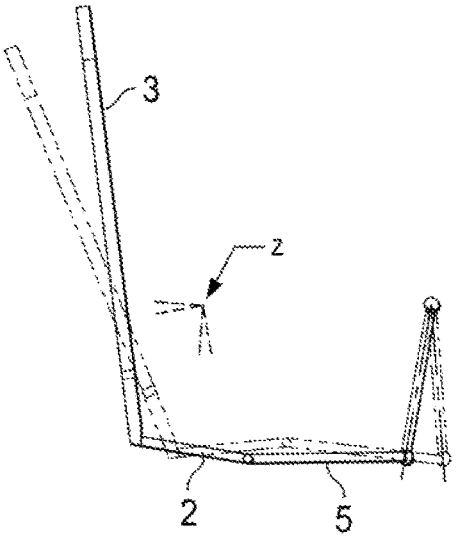

FIGS. 13A and 13B each show a support kinematic 28 arranged above the seat surface and its effect in both cases; the simplicity and good effects when the foremost edge of the seat surface is lowered are apparent, as is noticeable space requirement. The upper end of the rods of the support kinematic 28, one in front and one behind the plane of symmetry, is fixed to the base but mounted to move spherically, as is the connection to the corresponding seat surface. Especially in conjunction with an arm rest attached to the base, an application is also quite possible in office chairs and such a variant is also quite useful for treatment chairs, etc. Any necessary changes in length can be created by telescoping, spring-loaded rods.

Figure 14A:
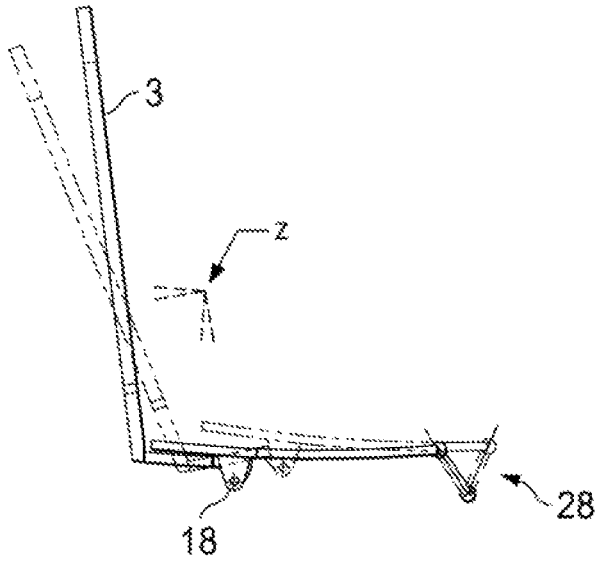
FIGS. 14A and 14B show the seating furniture of FIGS. 12A and 12B with possible "lower" connection.
Figure 14B:
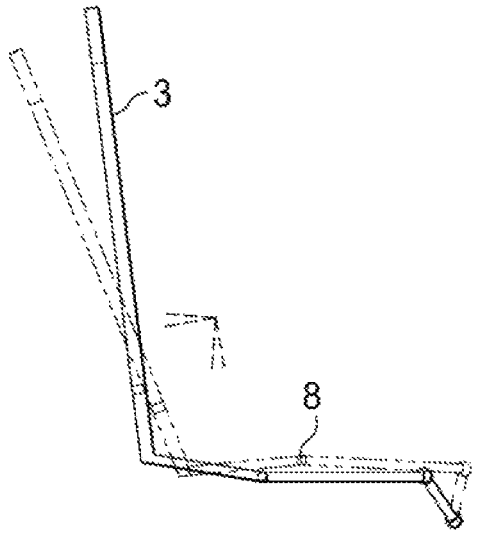

FIGS. 14A and 14B similarly show the arrangement of a support kinematic 28 provided beneath the seat surface, this being arranged in the plane of symmetry and therefore not requiring any length compensation. It is mounted with the lower end fixed to the base and can be moved spherically, likewise the connection to the corresponding seat surface; the small space requirement is quite noticeable.

Figure 15A:
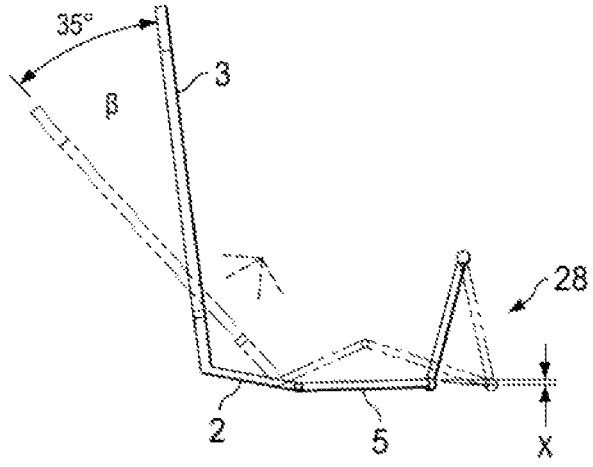
FIGS. 15A and 15B show the seating furniture of FIG. 12B with comparison of the connections.
Figure 15B:
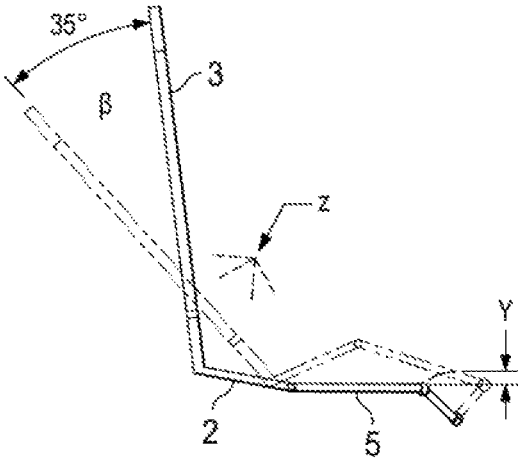

FIGS. 15A and 15B show, with a divided seat surface, the conditions in a resting chair with a large pivot angle β of the backrest 3 of 35°. The small height difference x, on the one hand, the comparatively significant intermediate raising y in, on the other, exhibit advantages and disadvantages for both systems in connection with the space requirements and the pivot range in the space used above the seat surface.

An entire series of support kinematics 28 that can be provided beneath the seat surface is shown, extremely schematically, with their arrangement in FIGS. 16A to 16L; these are explained in more detail below. With respect to the support kinematics of FIGS. 17A to 17L each has, from a purely kinematic viewpoint, the task of suitably restricting the degrees of freedom. In general, for this purpose:

The various support kinematics shown are positioned spherically with their upper end on the corresponding seat surface/front seat surface part 17, 5 with their lower end fitting on base 1; it is immediately apparent to a person skilled in the art from the illustration in FIG. 17 whether a spherical or rotatable kinematic is provided. Further, the remaining mobility is also indicated in FIG. 16 by the dash-dot lines. The vertical pivot axis shown in FIG. 16A, for example, can to a certain extent replace the rotation around the pneumatic spring of an office chair, but is hardly used in practice; this and similar variants are presented only to complete the disclosure and teaching.

It is also clearly evident that in the lower support kinematics 28 shown, the central pivot axis 11 lying in the plane of symmetry (for example, at 16A, 16B, 16F, etc.) deviates considerably from the horizontal and can only be used to a very limited extent in ordinary office chairs. The use of a second kinematic, as explained at the outset, which can be regarded as a lower support kinematic, by means of which a virtual pivot point located significantly above the seat surface is created, also proves to be advantageous here.

FIGS. 161 to 16L and 17I to 17L show special features insofar as the rods are replaced by mechanisms that ultimately change the lengths of the "rods" formed in this way during pivoting and thus allow the user to make further changes to the seat position. In the simplest case, 17A the rod can also be designed to be easily manually adjustable, for example, by being designed in the form of a spindle.

In one embodiment, support kinematic 28 is arranged beneath the seat surface or the front seat surface part, and the support kinematic includes either a rod that is spherically mounted at both sides, or includes a rod that is mounted to rotate spherically at one end and to rotate parallel to the plane of symmetry at a second end (see FIGS. 17A and 17E).

In another embodiment, support kinematic 28 is arranged beneath the seat surface or the front seat surface part, and the support kinematic includes two V-shaped interconnected rods, such that the two V-shaped interconnected rods are either spherically mounted at both ends, or the two V-shaped interconnected rods are mounted to rotate spherically at one end and to rotate parallel to the plane of symmetry at a second end (see FIGS. 17B and 17F).

In another embodiment, support kinematic 28 is arranged beneath the seat surface or the front seat surface part, and the support kinematic includes two rods arranged parallel to each other, such that the two rods are either spherically mounted at both ends, or the two rods are mounted to rotate spherically at one end and to rotate parallel to the plane of symmetry at a second end (see FIGS. 17C and 17G).

In another embodiment, support kinematic 28 is arranged beneath the seat surface or the front seat surface part, and the support kinematic includes two rods arranged parallel to each other and a connection rod that in combination form an "N" shape, such that the two rods are mounted to rotate spherically at one end and to rotate parallel to the plane of symmetry at a second end (see FIGS. 17D and 17H).

The variants A, E and I correspond to the constraint of one degree of freedom, variants B, C, F, G, I, J and K to the constraint of two degrees of freedom and variants D, H and L to the constraint of three degrees of freedom. The individual support kinematics can, of course, also be used "upside down".

Figure 18C:
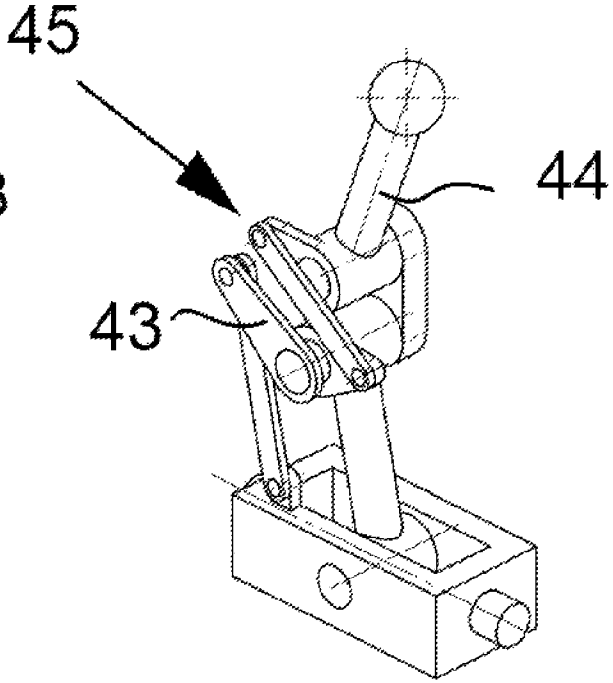
FIGS. 18A-18C show additional possibilities of connection.
Figure 18B:
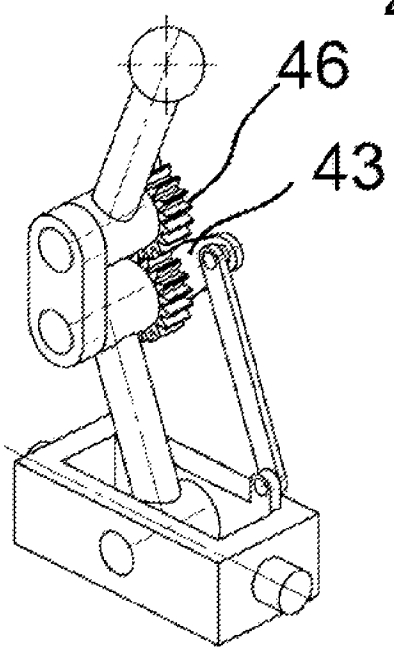
Figure 18A:
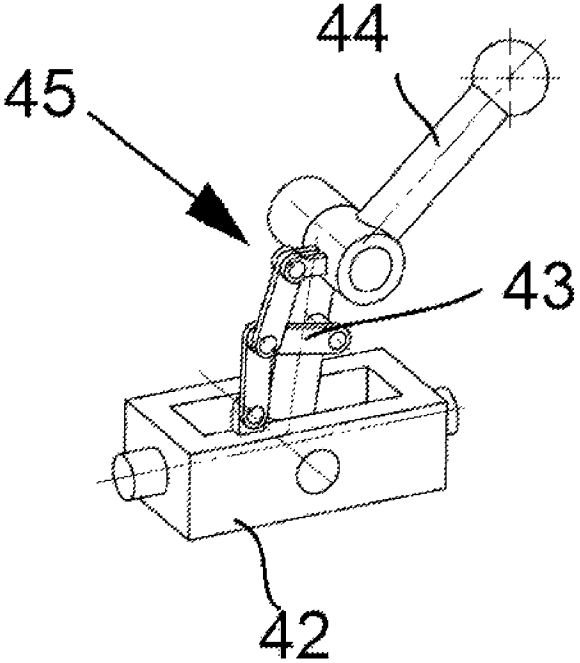

Additional embodiments are shown in FIGS. 18A to 18C, which involve non-linear gear units that can be used instead of the gear units of FIGS. 17I to 17L in order to obtain different angles between the backrest and seat surface during pivoting of the chair from the upright position to the back-leaning rest position. In such embodiments the gear unit can include two pulley disks of different diameter and a belt running around the two pulley disks. The belt can include a V-belt. Alternatively, or in addition, the belt can include a toothed belt and the two pulley disks can be toothed complementary to the belt. One or more of the two pulley disks can include keyways.

There are, of course, numerous other variants and embodiments for this purpose that are recognized as useful by a person skilled in the art with knowledge of the present disclosure, and therefore need not be discussed here.

Figure 19A:
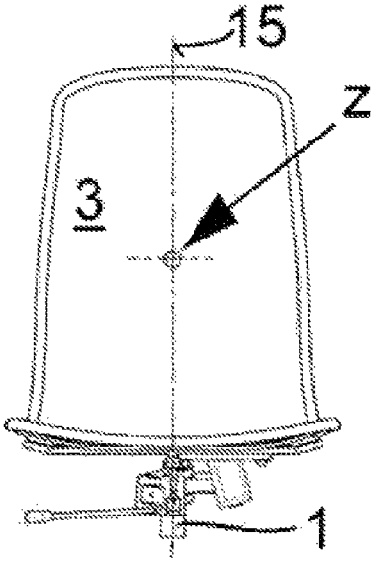
FIGS. 19A-19D show different views of an alternative illustrative seating furniture according to the present disclosure having only one kinematic and a support kinematic.
Figure 19B:
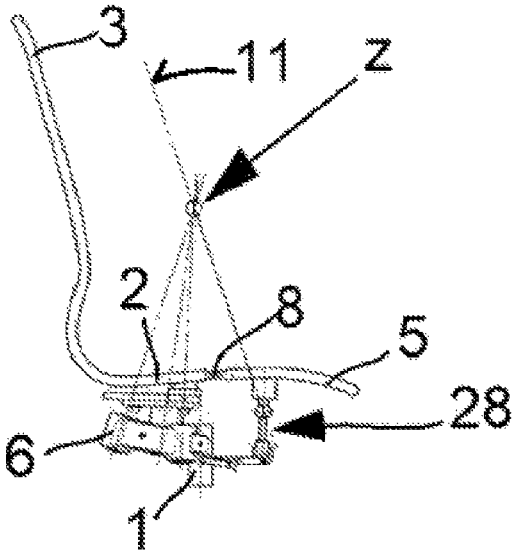
Figure 19C:
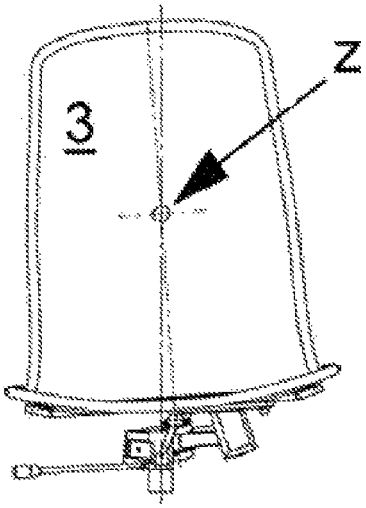
Figure 19D:
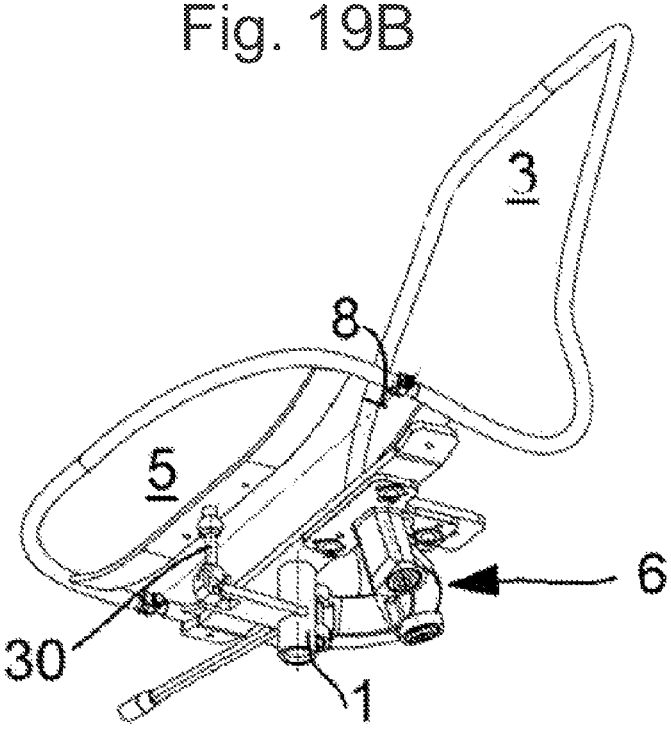

FIGS. 19A to 19D show an overall representation of seating furniture with only one kinematic and one support kinematic in FIG. 19A in the upright position from the front, in FIG. 19B from the side, in FIG. 19C in a laterally inclined position from the front, and in FIG. 19D in the rest position in a perspective view obliquely from below. The divided seat surface and the backrest in each case are indicated only by a type of frame so as not to obstruct the view of the mechanism.

Figure 16A:
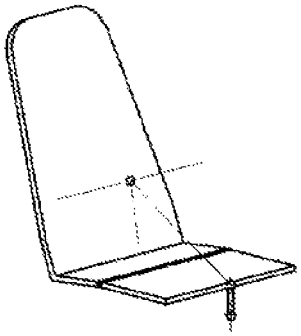
FIGS. 16A-16L show the seating furniture of FIG. 12A with different possibilities of lower connection.
Figure 16B:
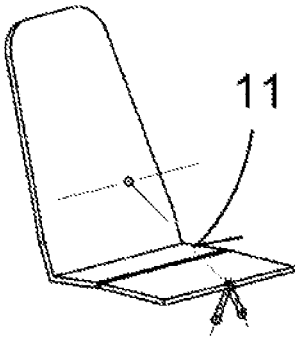
Figure 16C:
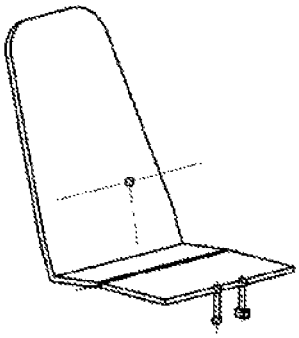
Figure 16D:
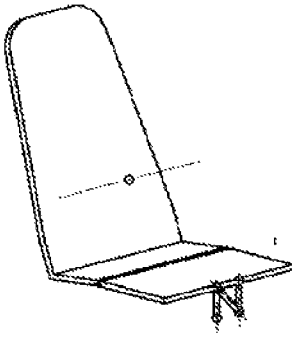
Figure 16E:
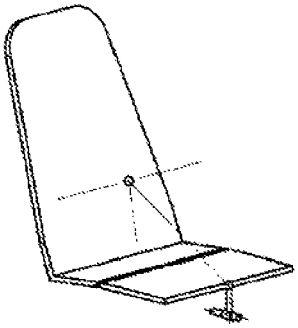
Figure 16F:
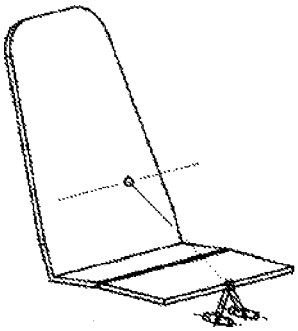
Figure 16G:
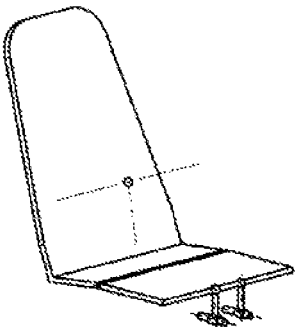
Figure 16H:
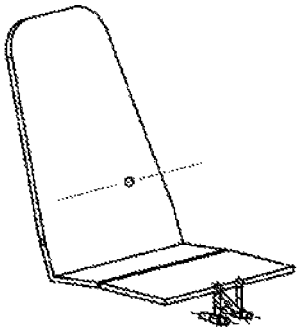
Figure 16I:
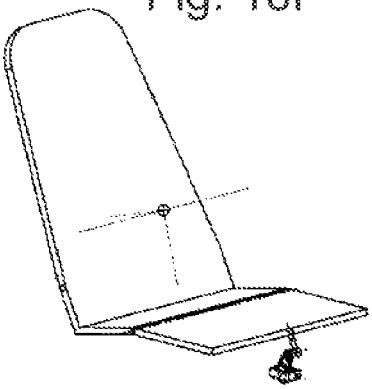
Figure 16J:
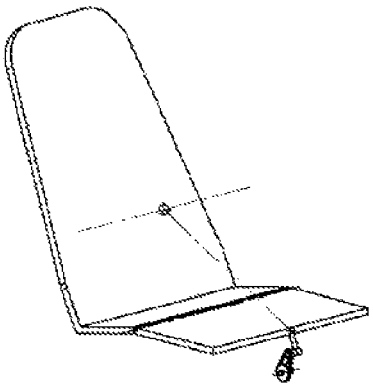
Figure 16K:
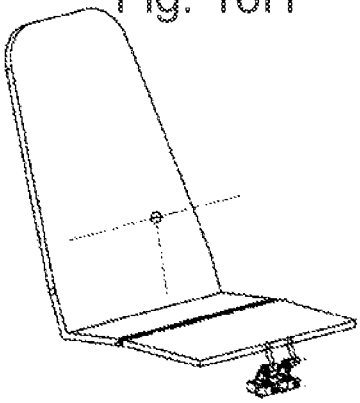
Figure 16L:
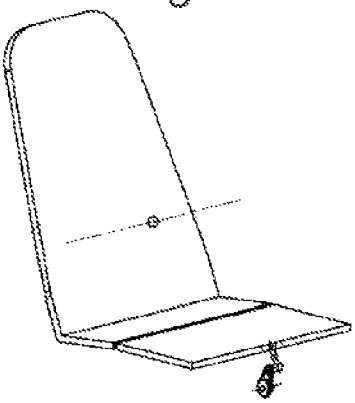

As can be seen from FIG. 19A, the support kinematic, in this case a simple rod 30 as shown in FIGS. 16A and 17A, is spherically connected at the top to the front seat surface part 5 and cardanically connected at the bottom to one arm of base 1, thus also spherically. The rod 30 lies in the plane of symmetry. FIG. 19B shows the situation in a side view, a support bracket firmly connected to the front seat surface part 5, which carries the support kinematic 28, thus the rod 30 including the bearing, is clearly visible, as is the extremely steeply running central pivot axis 11 here, but with only a limited prescribed transverse pivoting still usable.

FIG. 19C shows, in a view similar to FIG. 19A, the lateral rotation around the central pivot axis 11 apparent from FIG. 19B, extending from central point Z and the center of the upper spherical bearing of rod 30. The sharp forward lowering, even at the small pivot angle shown, is readily apparent.

FIG. 19D shows the entire mechanism well: the base 1 with its arm for kinematic 6 and its arm for the support kinematic 28 together with the cardan suspension for rod 30 and the arrangement of the support bracket on the front seat surface part 5 together with the spherical bearing. The position of the seat division axis 8 is also readily apparent. The hand lever shown in FIG. 19 serves to operate the height adjustment of the pneumatic spring arranged under the base and therefore is not causally related to the seating furniture disclosed herein.

Concerning the subject of the central area, it should also be stated that in the "general" case, there are three minimal distances with corresponding "near points" on the three axes A1, A2 and A3. Both the minimal distances between axes and the distances between the near points on one axis can amount to up to 10 cm without undesired effects occurring in the seating furniture, such as asymmetric behavior or non-circular movements. In the case of chairs for video games or seating furniture in the medical field with motor-driven movements, however, it is recommended, if only for reasons of better predictability of the imposed movement, and in fact practically necessary, to work with central points. For all mentioned areas of application, it is recommended to "position" the central point of the backrest well above the plane of the seat surface 17' and preferably in the area of the center of gravity of the person using the chair, which poses no problem to a person skilled in the art with knowledge of the basic design of furniture and the present disclosure.

All of the things not causally connected to the present disclosure have not been shown or described in the drawing and in the description. These include stops, movement limiters, devices for jamming protection, the bearing in detail; in the case of motors, their power supply and lines for control and the necessary sensors; arm rests, adjustable stiffeners of the backrest (lumbar supports), upholstery, transitions from the seat to the backrest and between the seat surfaces, all parts beneath the base, such as chassis, height adjustability, and more. Other elements, such as springs, which support certain movements or resist them in order to achieve a certain training effect during sitting are also not listed here.

In the description and the claims, the terms "front," "rear," "top," "bottom," and so forth are used in their generally accepted forms and with reference to the object in its usual position of use. That is, in the case of a weapon, the muzzle of the barrel is "forward," the breech or slide is moved "rearward" by the explosive gases, etc. In vehicles, "forward" is the usual direction of travel. "Running direction," if the hangers of a suspension railway are involved, and not the rails, refers to this direction on the hangers; transverse to it essentially means a direction rotated 90° and in essentially horizontal.

It should further be pointed out that in the description and claims, comments like "lower area" of a component or a device or, quite generally, of an object, refer to the lower half and in particular the lower quarter of the total height, the "lowermost area" means the lowermost quarter and in particular a still smaller part; whereas "middle area" means the middle third of the total height (analogously: width-length). All these indications have their generally accepted meanings applied to the intended position of the object being considered, unless stated otherwise.

In the description and claims "essentially" means a deviation up to 10% of the stated value, if physically possible, both downward and upward, otherwise only in the meaningful direction, and in degree statements (angle and temperature), ±10° is therefore meant.

All indications of quantities and proportions, in particular those relating to the delimitation of the scope of the present disclosure, insofar as they do not concern specific examples, are to be understood with ±10% tolerance, thus, for example, 11% means: from 9.9% to 12.1%. In designations such as "a solvent" the word "a" is not to be regarded as the numeral one, but as an indefinite article or pronoun, unless the context indicates otherwise.

The term "combination" or "combinations," unless otherwise indicated, means all types of combinations, starting from two of the constituents concerned up to a plurality or all of such constituents, and the term "containing" also means "consisting of".

The features and variants indicated in the individual embodiments and examples can be freely combined with those of the other examples and embodiments and, in particular, may be used to characterize the invention in the claims without necessarily incorporating the other details of the respective embodiment or example.

LIST OF REFERENCE NUMERALS

| | |
|---|---|
| 1 | Base |
| 2 | Rear seat surface part |
| 3 | Backrest |
| 4 | Arm support |
| 5 | Front seat surface part |
| 6 | Rear kinematic |
| 7 | Front kinematic |
| 8 | Seat division axis |
| 9 | Connection arm |
| 10 | Front pivot axis |
| 11 | Central pivot axis |
| 12 | Stiffening triangle |
| 13 | Horizontal |
| 14 | Seating furniture |
| 15 | Plane of symmetry |
| 16 | (Lateral) pivot joint |
| 17 | (Undivided) seat surface |
| 17' | Plane of seat surface |
| 18 | Connection axis |
| 19 | Adjustment device |
| 20 | Mounting block |
| 21 | Spindle |
| 22 | Handwheel |
| 23 | Nut(s) |
| 24 | Guide rod |
| 25 | Intermediate plate |
| 26 | Pivot device |
| 27 | Transfer rod |
| 28 | Support kinematic |
| 29 | Spring(s) |
| 30 | Rod (spherically mounted) |
| 31 | Rod, mounted differently |
| 32 | V-shaped rod, spherically mounted |
| 33 | V-shaped rod, mounted differently |
| 34 | Two rods, spherically mounted |
| 35 | Two rods, mounted differently |
| 36 | N-shaped rod, spherically mounted |
| 37 | N-shaped rod, mounted differently |
| 38 | Joint pivot |
| 39 | Rotatable rod |
| 40 | Rotatable rod |
| 41 | Gear unit |
| 42 | Joint base |
| 43 | Coupling |
| 44 | Second rod |
| 45 | Lever mechanism |
| 46 | Pair of wheels |
| A1, A2, A3 | Axes of the kinematics |
| F1, F2 | Virtual connections |
| x | Height difference |
| y | Intermediate raising |
| Z, Z1, Z2 | Central points |
| α | Intermediate angle |
| β | Pivot angle |

The invention claimed is:

1. An article of seating furniture having a plane of symmetry, comprising:

a base of the seating furniture;

a seat surface, where the seat surface is optionally divided into a rear seat surface part and a front seat surface part, such that either the single seat surface or the front seat surface part is connected to the base via a support kinematic that constrains at least one degree of freedom;

a backrest attached to the single seat surface or the rear seat surface part; and a main kinematic, arranged on a base of the seating furniture; the main kinematic having:

a base arm that is rotatable relative to the base around a base axis; and an end arm that is rotatable around the base arm around an intermediate axis;

wherein the main kinematic carries the backrest so that it is pivotable, and the backrest is mounted so as to be rotatable around the end arm around an end axis; an the base axis, the intermediate axis, and the end axis draw near to one another in a central area;

wherein the seat surface is rotatable relative to the backrest around a connection axis running orthogonally to the plane of symmetry; or the front seat surface part is rotatable relative to the rear seat surface part around a seat division axis running orthogonally to the plane of symmetry.

2. The article of seating furniture of claim 1, wherein the article of seating furniture is a chair.

3. The article of seating furniture of claim 1, wherein the main kinematic carries the backrest and the rear seat surface part so that they are pivotable.

4. The article of seating furniture of claim 1, wherein the backrest is firmly fixed to the rear seat surface part.

5. The article of seating furniture of claim 1, wherein the base axis, the intermediate axis, and the end axis intersect at a central point of the main kinematic in the central area.

6. The article of seating furniture of claim 5, wherein an extent of a pivot movement around the central point of the main kinematic is limited by a connecting structure of rods and pins, such that one end of the connecting structure is firmly connected to the base and a second end of the connecting structure is firmly connected to the rear seat surface part or the backrest.

7. The article of seating furniture of claim 5, wherein an extent of a pivot movement around the central point of the main kinematic is limited by a lever and joint structure, such that one end of the lever and joint structure is linked to the base and a second end of the lever and joint structure is linked to the rear seat surface part or the backrest.

8. The article of seating furniture of claim 5, further comprising a front kinematic joining the single seat surface or the front seat surface part to the base as the support kinematic;

wherein the front kinematic is configured to move the single seat surface or the front seat surface part spherically around a central point of the front kinematic, in that the central point of the main kinematic and the central point of the front kinematic lie in the plane of symmetry and above the single seat surface or seat surface parts; and the front kinematic is rotatably connected to the seat surface or the front seat surface part around a front pivot axis orthogonal to the plane of symmetry.

9. The article of seating furniture of claim 8, wherein the front pivot axis is formed on a lever arranged between the front kinematic and the seat surface or the front seat surface part.

10. The article of seating furniture of claim 8, wherein the front pivot axis is defined by a spherical bearing.

11. The article of seating furniture of claim 10, wherein the spherical bearing is a ball joint.

12. The article of seating furniture of claim 8, wherein the front pivot axis is defined by a cardan joint with skew axes.

13. The article of seating furniture of claim 8, wherein the front pivot axis is defined by an elastic connection made of plastic disposed between the front kinematic and the single seat surface or the front seat surface part.

14. The article of seating furniture of claim 8, wherein the central point of the main kinematic and the central point of the front kinematic define a central pivot axis having an angle of less than 45° relative to a horizontal line.

15. The article of seating furniture of claim 8, wherein the central point of the main kinematic and the central point of the front kinematic define a central pivot axis having an angle of less than 15° relative to a horizontal line.

16. The article of seating furniture of claim 8, wherein the central point of the main kinematic and the central point of the front kinematic define a central pivot axis having an angle of less than 5° relative to a horizontal line.

17. The article of seating furniture of claim 8, wherein the central point of the main kinematic and the central point of the front kinematic define a central pivot axis having an angle relative to a horizontal line of between 15° and 30°.

18. The article of seating furniture of claim 8, wherein the central point of the main kinematic and the central point of the front kinematic define a central pivot axis having an angle relative to a horizontal line of between 20° and 27°.

19. The article of seating furniture of claim 8, wherein the central point of the main kinematic and the central point of the front kinematic define a central pivot axis having an angle relative to a horizontal line of approximately 25°.

20. The article of seating furniture of claim 1, wherein one of the seat division axis and the connection axis is formed by a hinge between the backrest and the seat surface.

21. The article of seating furniture of claim 1, wherein one of the seat division axis and the connection axis is formed by two lateral pivot joints between the backrest and the seat surface.

22. The article of seating furniture of claim 1, wherein one of the seat division axis and the connection axis is formed by an elastic connection made of plastic between the front seat surface part and the rear seat surface part or between the backrest and the seat surface.

23. The article of seating furniture of claim 1, wherein the seat surface is divided into the rear seat surface part and the front seat surface part, and the rear seat surface part is formed in one piece with the backrest.

24. The article of seating furniture of claim 1, wherein the rear seat surface part is elastically connected to the backrest.

25. The article of seating furniture of claim 1, wherein the base is mounted or formed on a support frame that is optionally movable.

26. The article of seating furniture of claim 25, wherein the base is rotatably mounted and/or height-adjustable relative to the support frame around a vertical axis.

27. The article of seating furniture of claim 1, wherein the support kinematic is arranged beneath the single seat surface or the front seat surface part, and the support kinematic includes either a rod that is spherically mounted at both sides, or includes a rod that is mounted to rotate spherically at one end and to rotate parallel to the plane of symmetry at a second end.

28. The article of seating furniture of claim 1, wherein the support kinematic is arranged beneath the seat surface or the front seat surface part, and the support kinematic includes two V-shaped interconnected rods, such that the two V-shaped interconnected rods are either spherically mounted at both ends, or the two V-shaped interconnected rods are mounted to rotate spherically at one end and to rotate parallel to the plane of symmetry at a second end.

29. The article of seating furniture of claim 1, wherein the support kinematic is arranged beneath the seat surface or the front seat surface part, and the support kinematic includes two rods arranged parallel to each other, such that the two rods are either spherically mounted at both ends, or the two rods are mounted to rotate spherically at one end and to rotate parallel to the plane of symmetry at a second end.

30. The article of seating furniture of claim 1, wherein the support kinematic is arranged beneath the seat surface or the front seat surface part, and the support kinematic includes two rods arranged parallel to each other and a connection rod that in combination form an "N" shape, such that the two rods are mounted to rotate spherically at one end and to rotate parallel to the plane of symmetry at a second end.

31. The article of seating furniture of claim 1, wherein the support kinematic includes at least two rods that are rotatable relative to each other around a joint pivot axis orthogonal to the plane of symmetry, in that an angular position of the at least two rods are adjustable relative to each other via a gear unit as a function of a position of the backrest, and in that a number of degrees of freedom constrained by the support kinematic is determined by different positioning on the base and either the seat surface or the front seat surface part.

32. The article of seating furniture of claim 31, wherein the gear unit includes two pulley disks of different diameter and a belt running around the two pulley disks.

33. The article of seating furniture of claim 32, wherein the belt is a V-belt and the two pulley disks include keyways.

34. The article of seating furniture of claim 32, wherein the belt is a toothed belt and the two pulley disks are toothed.

35. The article of seating furniture of claim 31, wherein the gear unit is a non-linear gear unit that includes a four-bar linkage, such that:

a joint base of the four-bar linkage is connected either to the base or to the seat surface with a front seat surface part;

one end of a second rod is connected to its coupling and a second end of the second rod is connected either to the seat surface or to the front seat surface part or to the base; and a lever mechanism or a pair of wheels determines an angular position between the four-bar linkage and the second rod.

36. The article of seating furniture of claim 1, further comprising:

motors provided between the base axis, the intermediate axis, and the end axis and/or provided in an area of the support kinematic between the base and the front seat surface part of the seat surface.

37. The article of seating furniture of claim 36, wherein the motors further include gear units that are activatable and controllable by an electronic control device.

* * * * *